US009295866B2

(12) United States Patent
Kwo

(10) Patent No.: US 9,295,866 B2
(45) Date of Patent: Mar. 29, 2016

(54) PORTABLE BALLET BAR EXERCISE DEVICE

(71) Applicant: Fluidity Enterprises, Inc., Jacksonville, FL (US)

(72) Inventor: Jennie Kwo, Cambridge, MA (US)

(73) Assignee: Fluidity Enterprises, Inc., Jacksonville, FL (US)

( * ) Notice: Subject to any disclaimer, the term of this patent is extended or adjusted under 35 U.S.C. 154(b) by 181 days.

(21) Appl. No.: 13/871,958

(22) Filed: Apr. 26, 2013

(65) Prior Publication Data

US 2013/0331232 A1 Dec. 12, 2013

Related U.S. Application Data

(60) Provisional application No. 61/638,803, filed on Apr. 26, 2012.

(51) Int. Cl.
*A63B 1/00* (2006.01)
*A63B 71/02* (2006.01)

(52) U.S. Cl.
CPC ..... *A63B 1/00* (2013.01); *A63B 71/023* (2013.01); *A63B 2071/027* (2013.01); *A63B 2210/50* (2013.01); *A63B 2244/22* (2013.01)

(58) Field of Classification Search
CPC .. A63B 1/00; A63B 2210/50; A63B 23/1218; A63B 2225/093; A63B 21/00047; A63B 2208/0204; A63B 21/1469; A63B 2023/006; A63B 21/0557; A63B 23/00; A63B 21/0023
USPC ..... 482/23, 38, 41–42, 148, 907–910; D21/691
See application file for complete search history.

(56) References Cited

U.S. PATENT DOCUMENTS

| | | | | |
|---|---|---|---|---|
| 860,517 | A | 7/1907 | Berglund | |
| 2,932,510 | A * | 4/1960 | Kravitz | 482/38 |
| 3,800,338 | A | 4/1974 | Smith | |
| 3,944,219 | A * | 3/1976 | LoPresti | 482/38 |
| 4,008,892 | A * | 2/1977 | Nissen | 482/16 |
| 4,111,414 | A | 9/1978 | Roberts | |
| 4,126,307 | A | 11/1978 | Stevenson | |
| 4,696,470 | A | 9/1987 | Fenner | |
| 4,815,732 | A | 3/1989 | Mahvi | |
| 5,046,722 | A | 9/1991 | Antoon | |
| 5,080,352 | A | 1/1992 | Freed | |
| 5,277,676 | A | 1/1994 | Holland et al. | |
| 5,306,217 | A * | 4/1994 | Bracone | 482/55 |
| 5,389,055 | A | 2/1995 | Gangloff | |

(Continued)

FOREIGN PATENT DOCUMENTS

| | | |
|---|---|---|
| TW | M268074 | 6/2005 |
| TW | M281657 | 12/2005 |

(Continued)

OTHER PUBLICATIONS

PCT Search Report mailed on Aug. 16, 2013 corresponding to the related PCT Patent Application No. US2013/038526.

(Continued)

*Primary Examiner* — Loan H Thanh
*Assistant Examiner* — Andrew S Lo
(74) *Attorney, Agent, or Firm* — DLA Piper LLP

(57) ABSTRACT

Multiple embodiments of a portable ballet bar exercise device are disclosed.

19 Claims, 28 Drawing Sheets

(56) References Cited

U.S. PATENT DOCUMENTS

| | | | | |
|---|---|---|---|---|
| 5,405,306 | A | 4/1995 | Goldsmith et al. | |
| 5,501,647 | A | 3/1996 | Snyder | |
| D372,059 | S * | 7/1996 | Taylor | D21/691 |
| 5,662,556 | A | 9/1997 | Gangloff | |
| 5,697,875 | A * | 12/1997 | Stan | 482/141 |
| 5,776,037 | A | 7/1998 | Millington | |
| D410,050 | S * | 5/1999 | Matte | D21/691 |
| 6,248,047 | B1 | 6/2001 | Abdo | |
| 6,336,414 | B1 | 1/2002 | Stewart et al. | |
| 6,415,723 | B1 | 7/2002 | Kopish et al. | |
| 6,652,419 | B1 | 11/2003 | Rota | |
| 6,699,162 | B2 | 3/2004 | Chen | |
| 6,743,152 | B2 | 6/2004 | Weiss | |
| 7,275,273 | B2 | 10/2007 | Lary et al. | |
| 7,494,454 | B2 | 2/2009 | Sheets | |
| 7,608,029 | B2 | 10/2009 | Weiss et al. | |
| D633,962 | S * | 3/2011 | Stacey | D21/691 |
| 2006/0035750 | A1 * | 2/2006 | Weiss et al. | 482/34 |
| 2006/0122044 | A1 * | 6/2006 | Ho | 482/123 |
| 2009/0098987 | A1 * | 4/2009 | McBride et al. | 482/133 |
| 2009/0111657 | A1 * | 4/2009 | Snow | A63B 21/1426 482/4 |
| 2010/0190612 | A1 * | 7/2010 | Cook | 482/38 |
| 2012/0077655 | A1 * | 3/2012 | Wilson | 482/142 |
| 2012/0202661 | A1 * | 8/2012 | Jordan | 482/142 |
| 2013/0345026 | A1 * | 12/2013 | Eberflus et al. | 482/38 |

FOREIGN PATENT DOCUMENTS

| | | |
|---|---|---|
| TW | I271210 | 1/2007 |
| TW | M425695 | 4/2012 |

OTHER PUBLICATIONS

Search Report of R.O.C. (Taiwanese) Patent Application No. 102115090 (Chinese and English translation of Search Report); dated Jul. 15, 2014.

* cited by examiner

PORTABLE BALLET BAR EXERCISE DEVICE

PRIORITY CLAIM

This application claims priority under 35 USC 119(e) and 120 to U.S. Provisional Patent Application Ser. No. 61/638,803, filed on Apr. 26, 2012, which is incorporated by reference herein.

TECHNICAL FIELD

Multiple embodiments of a portable ballet bar exercise device are disclosed.

BACKGROUND OF THE INVENTION

Fixed ballet bars are standard equipment in dance studios and exercise facilities. Ballet bars are used by dancers and persons exercising to keep their balance while engaging in stretching, dancing, cardio-vascular, weight-strengthening, and other exercise activities.

The assignee of this application is an innovator in free-standing ballet bar exercise devices and previously obtained U.S. Pat. Nos. 6,743,152 and 7,608,029, both of which are incorporated by reference herein.

Prior art free-standing ballet bars sometimes could be relatively heavy and cumbersome to use. In addition, they often were somewhat difficult to store because they could not be easily collapsed into a compact configuration.

What is needed is an improved portable ballet bar exercise device that is adjustable in height, easier to assemble, collapse, transport, and store than the prior art devices. What is further needed is a portable ballet bar with an improved structural design. What is further needed is a portable ballet bar with fewer components, to simplify the manufacturing and assembly process.

SUMMARY OF THE INVENTION

Multiple embodiments of a portable exercise bar are disclosed.

DETAILED DESCRIPTION OF THE PREFERRED EMBODIMENTS

Figure 1:
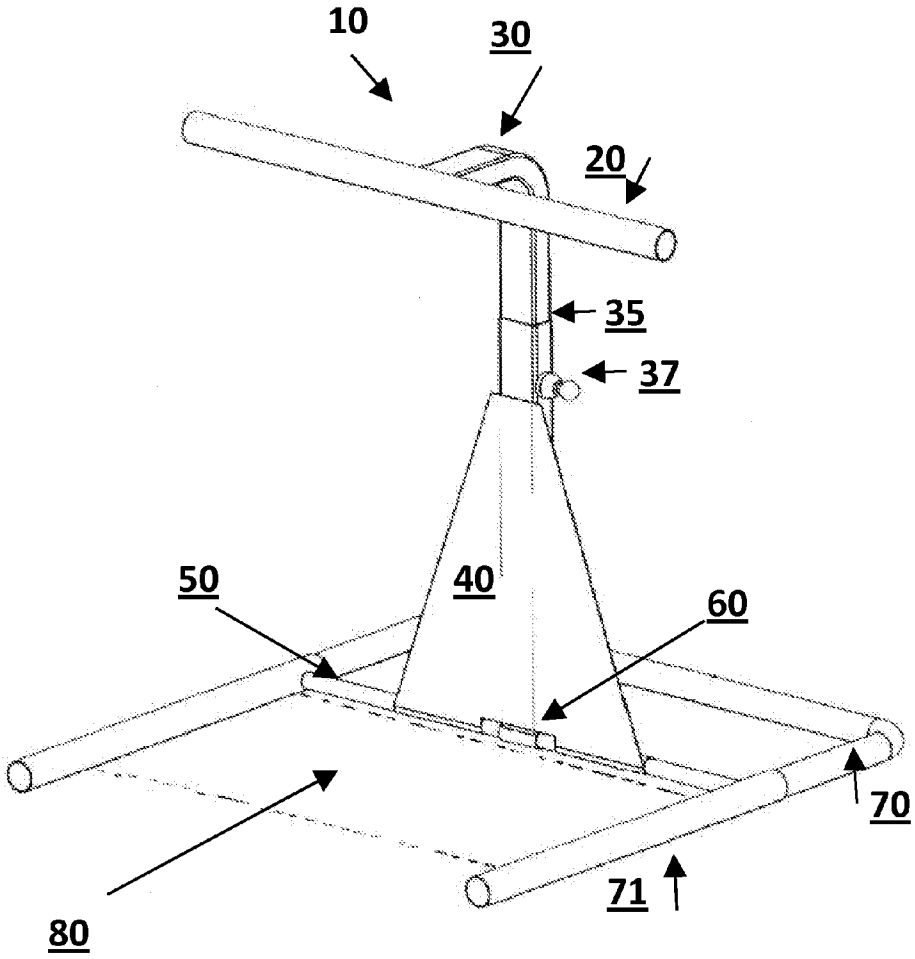
FIG. 1 depicts a first embodiment of a portable exercise bar.

FIG. 1 depicts an embodiment of a portable exercise bar 10. Portable exercise bar comprises horizontal bar 20, neck 30, vertical column 35, spring knob 37, backboard 40, crossbar 50, hinge 60, base 71, and floor board 80. Base 71 comprises rear legs 70 that are extendable from other portions of base 71.

During operation, a user can hold horizontal bar 20 while exercising or stretching, just as he or she could with a fixed ballet bar. Horizontal bar 20 is coupled to neck 30, neck 30 is coupled to vertical column 35, and vertical column 35 is coupled to backboard 40. Backboard 40 is coupled to cross bar 50 via hinge 60. Hinge 60 also is coupled to floor board 80. Cross bar 50 is coupled to base 71. Rear legs 70 typically will be placed in the fully extended position during use and retracted into base 71 for reduced size for storage. Thus, the size of base 71 is adjustable through the use of rear legs 70.

Spring knob 37 locks neck 30 and vertical column 35 when inserted. When spring knob 37 is pulled out, neck 30 can move up or down freely within vertical column 35.

Figure 2:
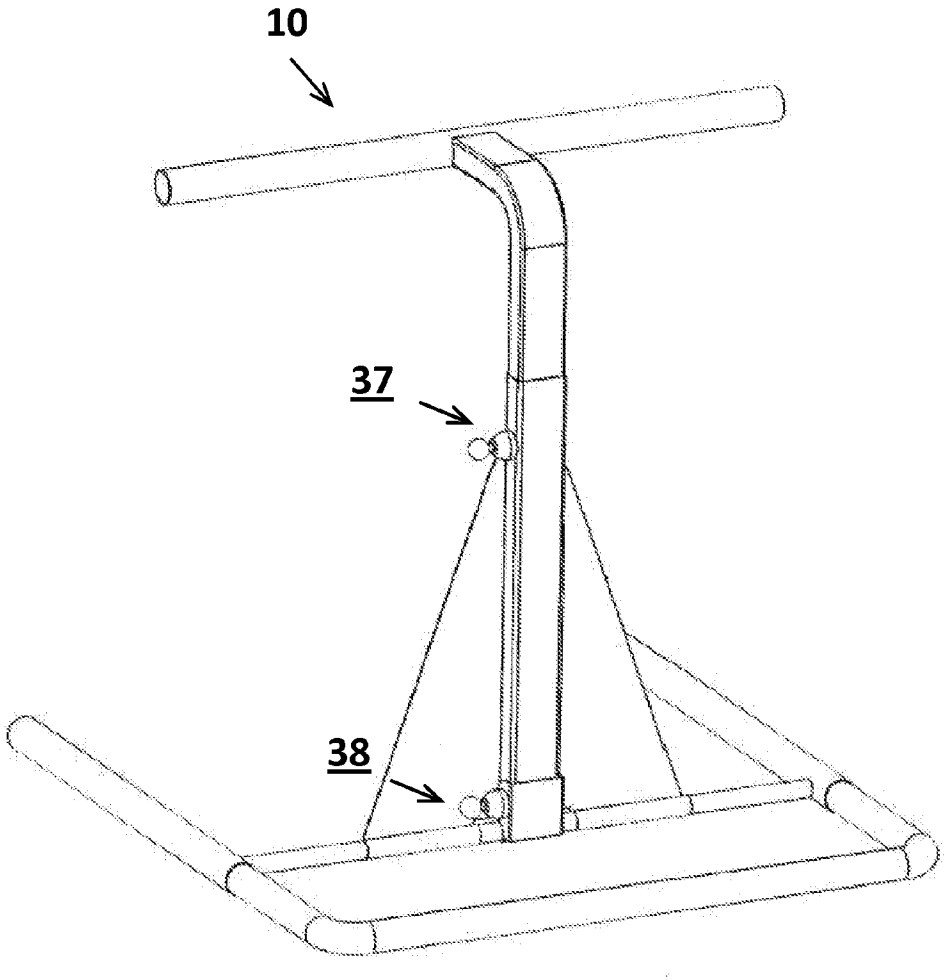
FIG. 2 depicts a back view of the first embodiment of a portable exercise bar.
Figure 3:
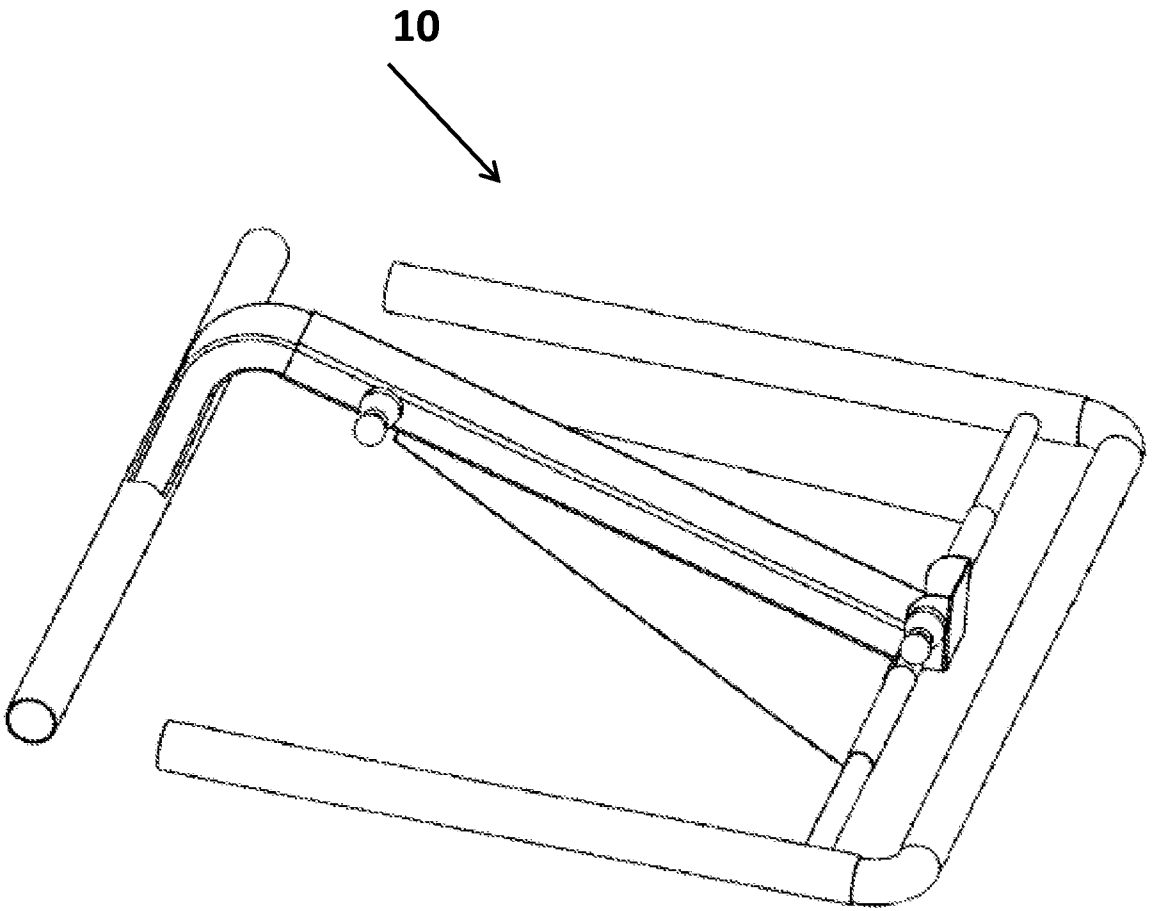
FIG. 3 depicts the first embodiment of a portable exercise bar in a collapsed position.
Figure 4:
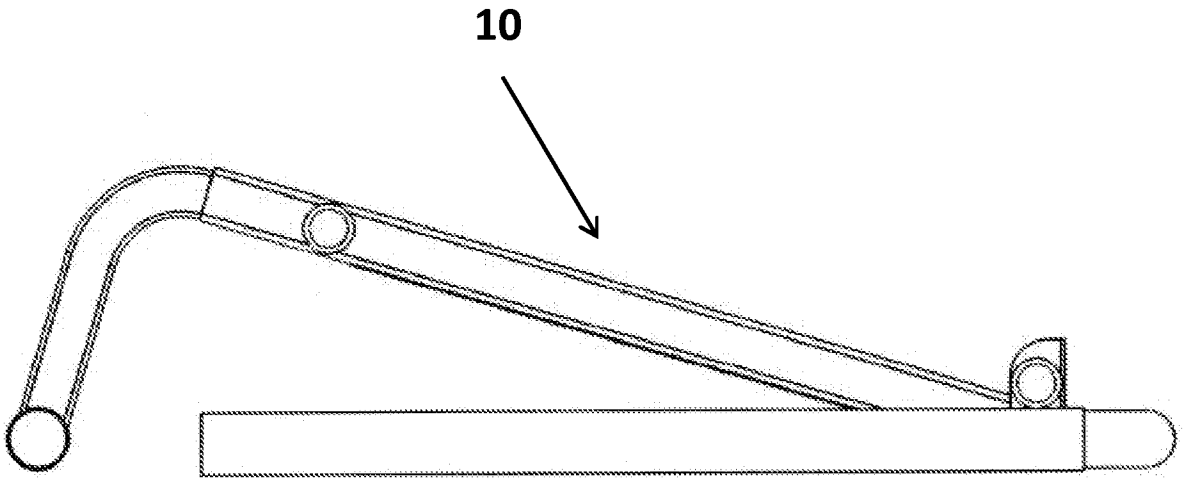
FIG. 4 depicts a side view of the first embodiment of a portable exercise bar in a collapsed position.

FIG. 2 depicts a back view of portable exercise bar 10. Spring knob 38 is similar to spring knob 37 and locks vertical column 35 in place vertically when inserted. When spring knob 38 is pulled out, vertical column 35, backboard 40, neck 30, and horizontal bar 20 can pivot around hinge 60, such that the apparatus can be folded into a more compact form for storage. Portable exercise bar 10 is depicted in this folded configuration in FIGS. 3 and 4. As can be seen, portable exercise bar 10 can be placed in a compact configuration that will make portable exercise bar 10 easier for a user to store.

Figure 5:
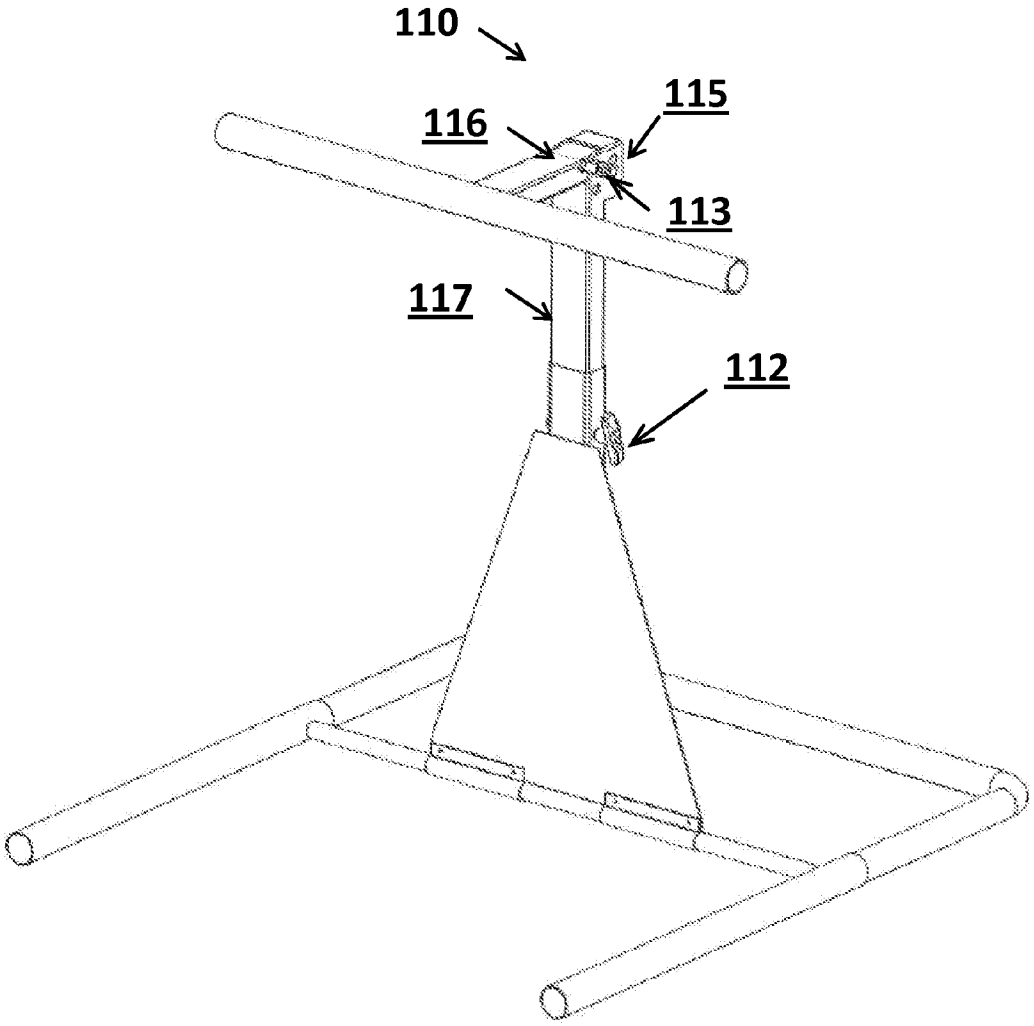
FIG. 5 depicts a second embodiment of a portable exercise bar.

A second embodiment is shown in FIG. 5 as portable exercise bar 110. Many of the parts of this embodiment are the same as the previous embodiment discussed with reference to FIGS. 1-4, and for efficiency's sake, those will not be described again.

Instead of spring knob 37, portable exercise bar 110 uses detent pin 112. Detent pin 112 locks neck 30 and vertical column 35 when inserted. When detent pin 37 is pulled out, neck 30 can move up or down freely within vertical column 35. Detent pin 113 locks the horizontal and vertical portions of neck 30.

Neck 30 is a two part assembly comprising first structure 116 and second structure 117. The hinge point is at junction 115. First structure 116 is able to rotate about junction 115. Detent pin 113 locks first structure 116 in either the horizontal or vertical position with respect to second structure 117.

Figure 6:
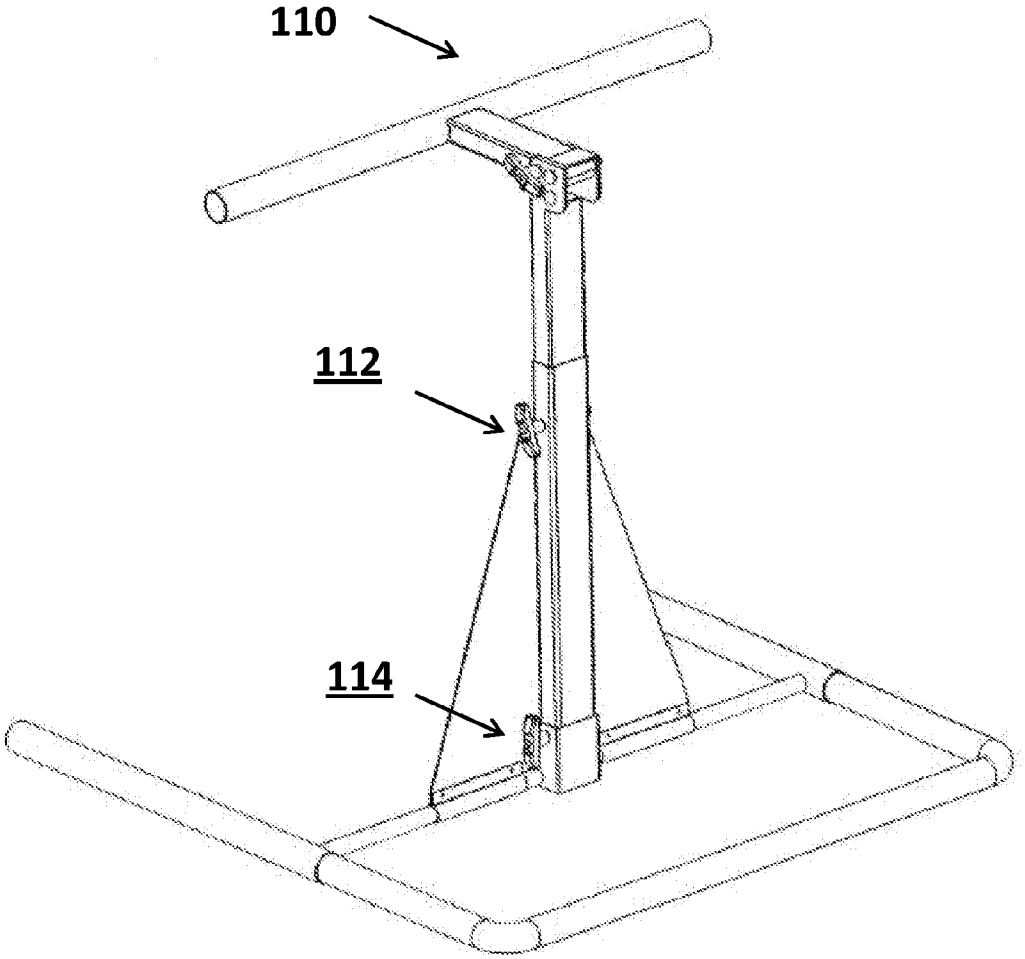
FIG. 6 depicts a back view of the second embodiment of a portable exercise bar.

FIG. 6 depicts a back view of portable exercise bar 110. Detent pin 114 is similar to detent pin 112 and detent pin 113 and locks vertical column 35 in place vertically when inserted. When detent pin 114 is pulled out, vertical column 35, backboard 40, neck 30 (or first structure 116 and second structure 117), and horizontal bar 20 can pivot around hinge 60, such that the apparatus can be collapsed into a more compact form for storage.

Figure 7:
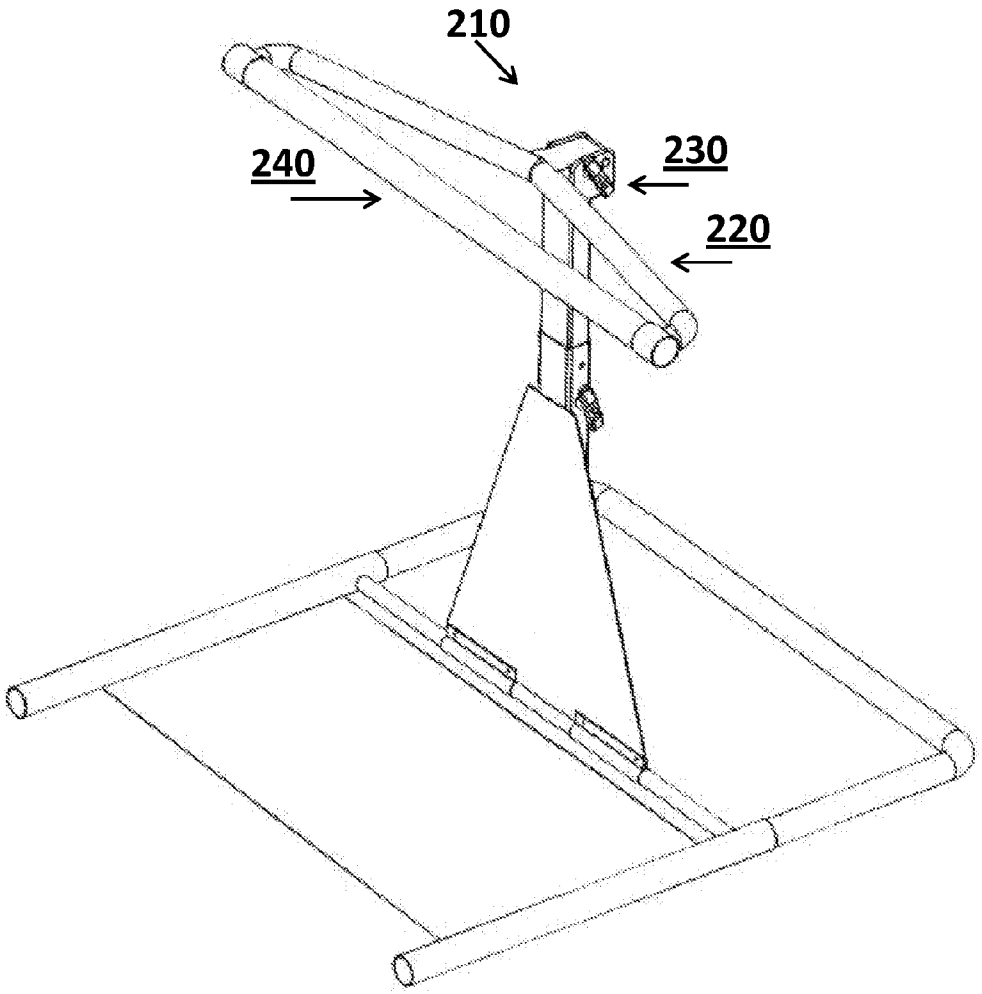
FIG. 7 depicts a third embodiment of a portable exercise bar.

A third embodiment is shown in FIG. 7 as portable exercise bar 210. Many of the parts of this embodiment are the same as the previous embodiment discussed with reference to FIGS. 1-6, and for efficiency's sake, will not be described again.

Portable exercise bar 210 comprises v-shaped support bar 220. V-shaped support bar 220 is coupled to neck 230. V-shaped support bar 220 also is coupled to horizontal bar 240. Portable exercise bar 210 uses detent pin 112, detent pin 113, and detent pin 114, as was the case with the embodiment of FIGS. 5-6.

Figure 8:
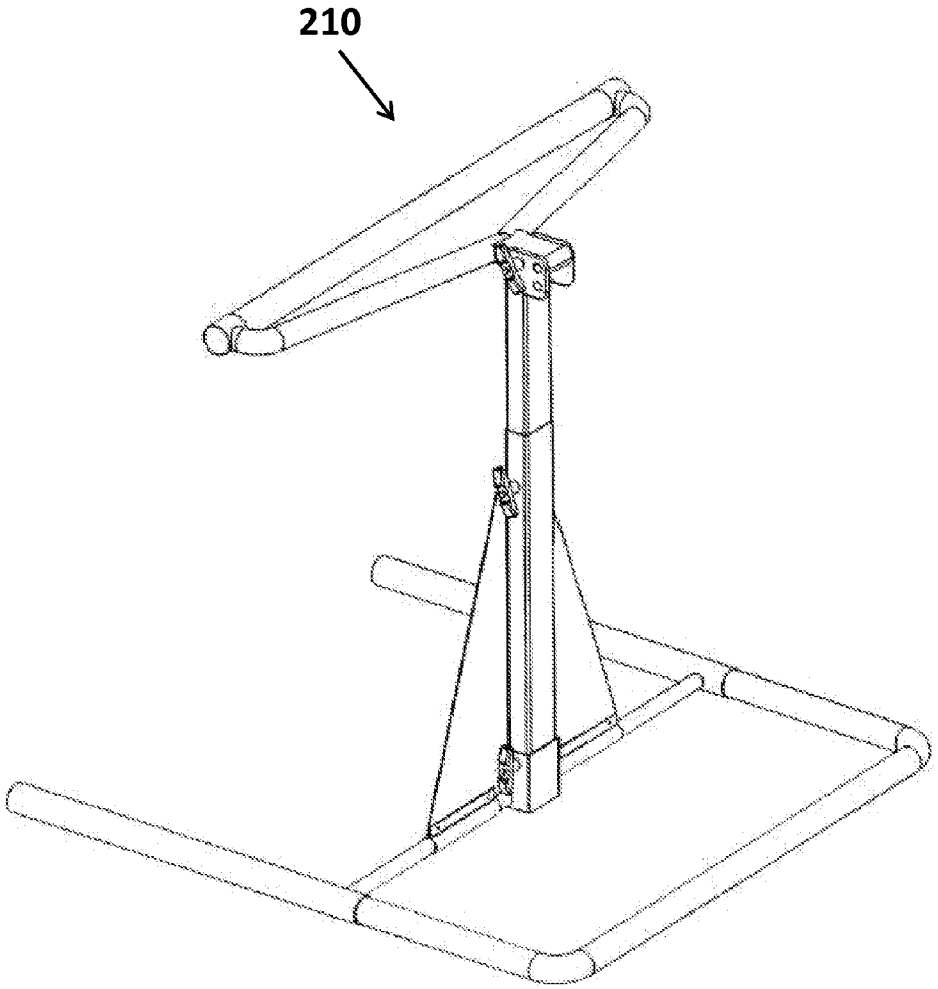
FIG. 8 depicts a back view of the third embodiment of a portable exercise bar.

FIG. 8 depicts a back view of portable exercise bar 210.

Figure 9:
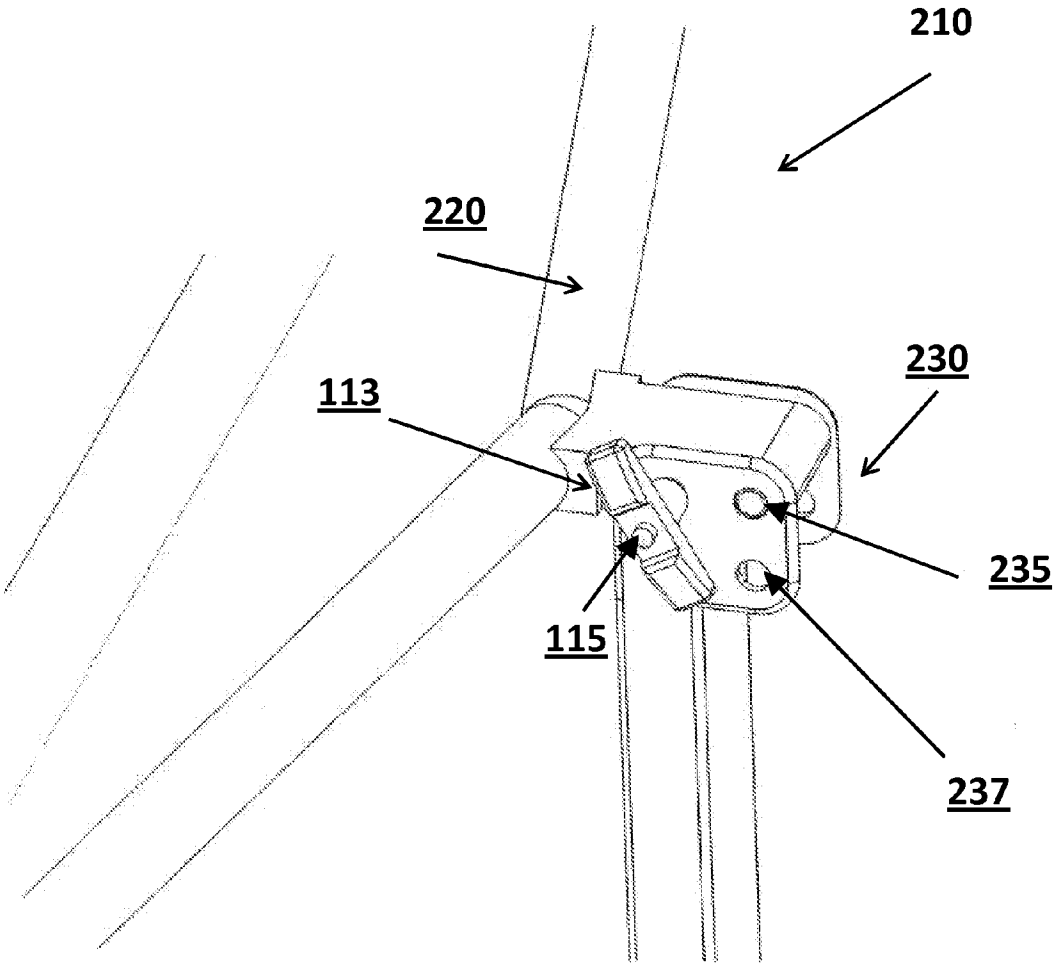
FIG. 9 depicts a neck portion of the third embodiment of a portable exercise bar.

FIG. 9 depicts a portion of neck 230. Neck 230 is coupled to detent pin 113. Detent pin 113 in the position shown will lock V-shaped support bar 220 to neck 230. When detent pin 113 is removed, v-shaped support bar 220 pivots around hinge pin 235. Detent pin 113 can be placed in hole 237 for storage.

As can be seen in FIG. 9, detent pin 113 comprises button 115. When button 115 is pressed, detent pin 113 narrows in diameter at the end of the pin, allowing detent pin 113 to be pulled out from neck 230. When button 115 is not pressed, detent pin 113 will lock in place in neck 230. Other detent pins described herein, such as detent pins 112 and 114, comprise a similar button.

Figure 10:
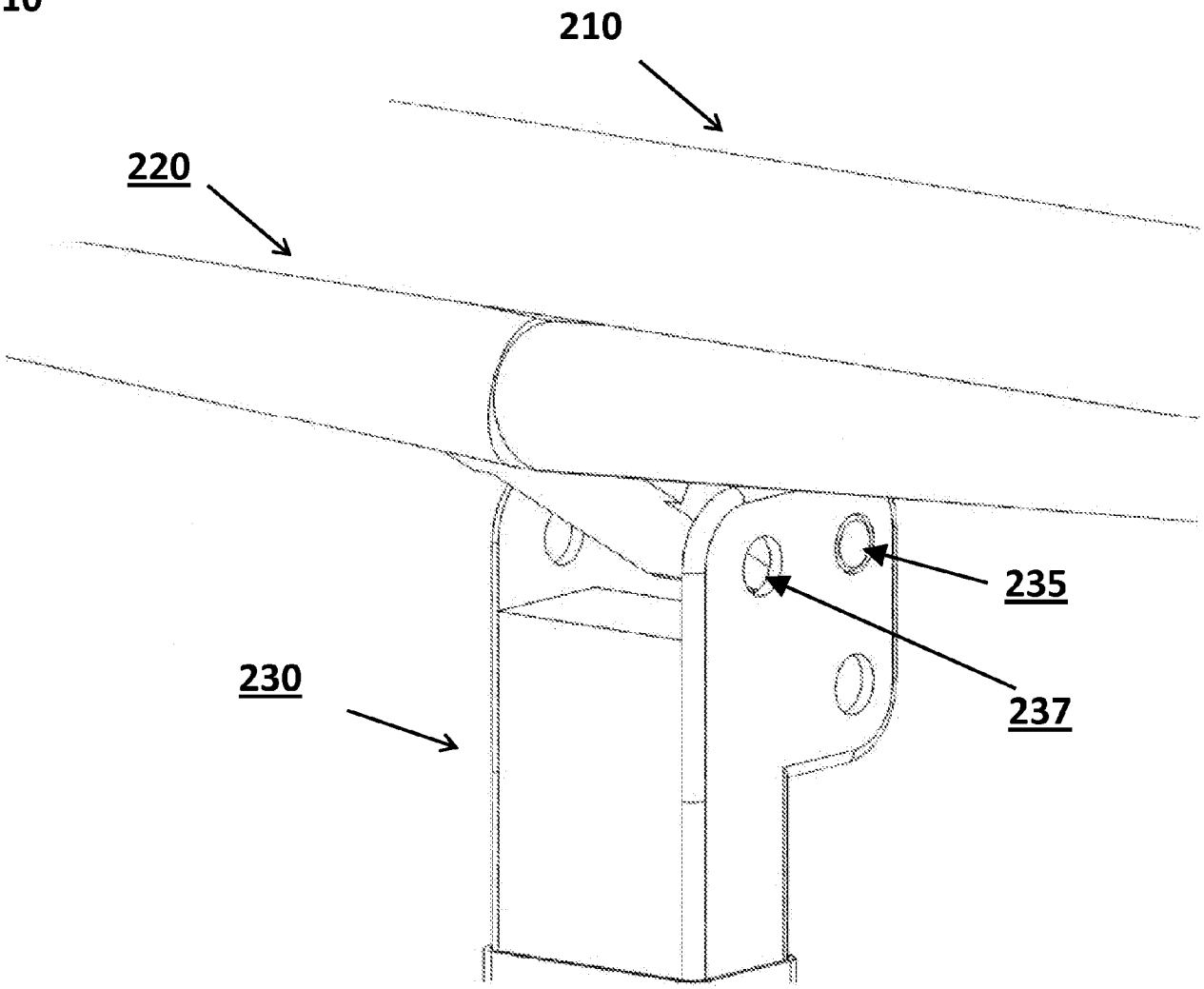
FIG. 10 depicts a different side view of the neck portion of the third embodiment of a portable exercise bar.

FIG. 10 depicts a different view of neck 230, v-shaped support bar 220, hinge pin 235, and hole 237.

Figure 11:
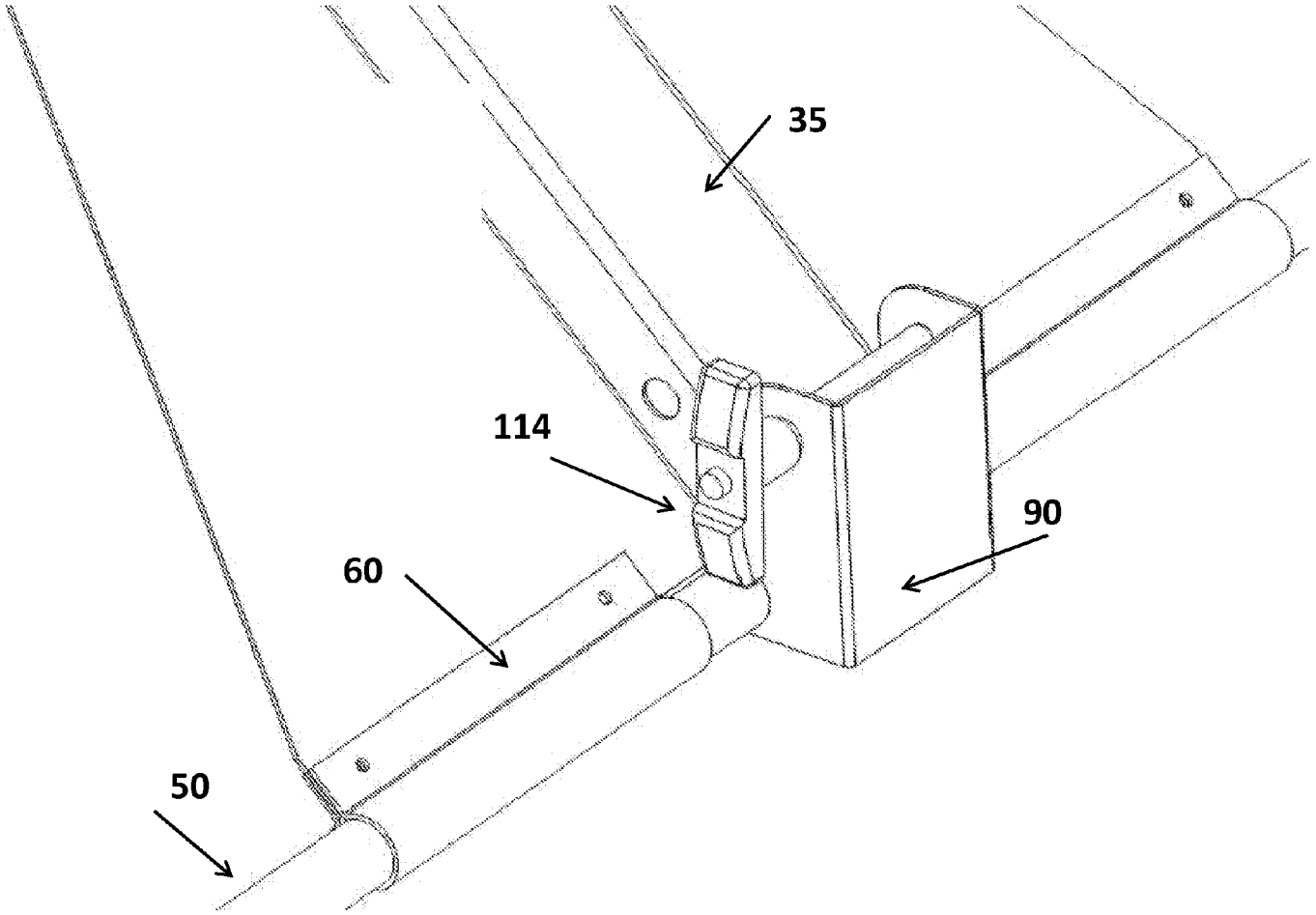
FIG. 11 depicts a cross bar and hinge support in the third embodiment of a portable exercise bar.

FIG. 11 depicts a view of the coupling optionally used in the embodiments of FIGS. 1-10 between vertical bar 35 and cross bar 50. The coupling comprises hinge 60 and hinge support 90, which is permanently fixed to cross bar 50. Detent pin 114 locks vertical bar 35 in vertical position when in place. When detent pin 114 is pulled out, vertical bar 35 can fold down via hinge 60 so that the portable exercise bar can be stored in a more compact configuration. The mechanism of FIG. 11 can be used with the portable exercise bar 10, portable exercise bar 110, and portable exercise bar 210. In an alternative design, detent pin 114 can be replaced with a spring knob, such as spring knob 38, or by any other appropriate locking mechanism.

Figure 12:
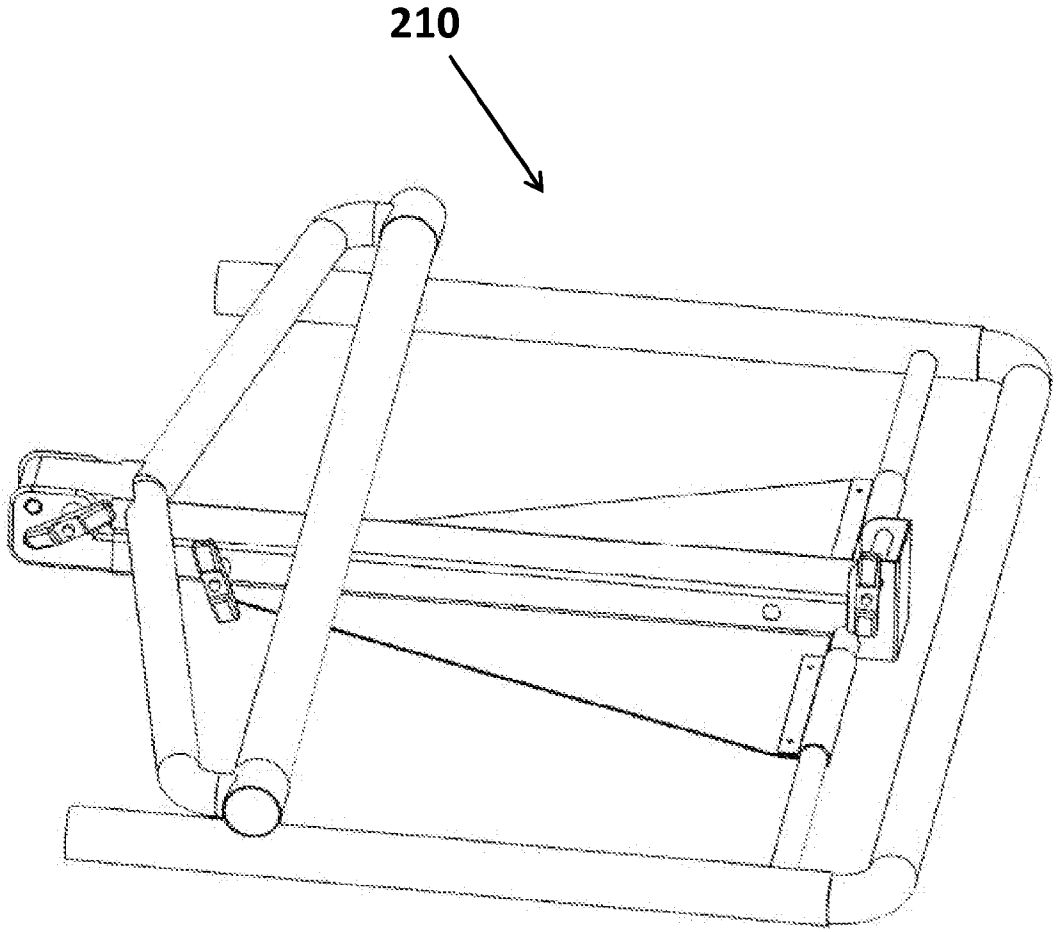
FIG. 12 depicts the third embodiment of a portable exercise bar in a collapsed position.
Figure 13:
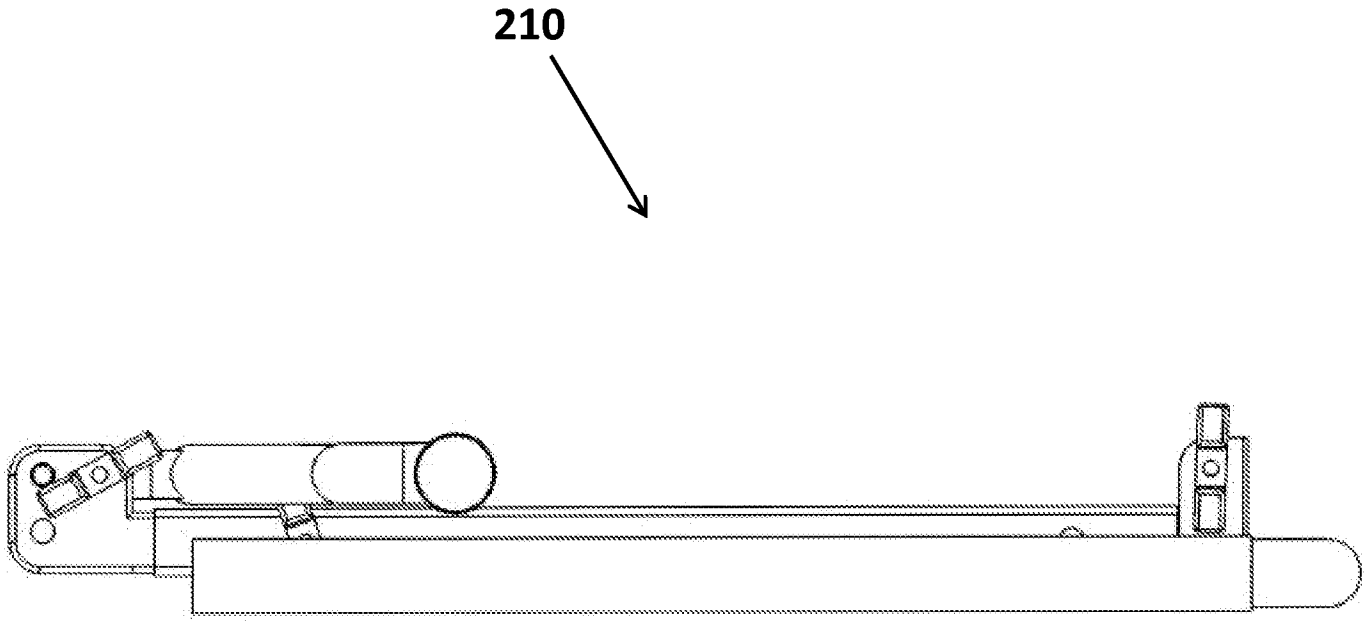
FIG. 13 depicts a side view of the third embodiment of a portable exercise bar in a collapsed position.

FIGS. 12 and 13 depict portable exercise bar 210 in a compressed configuration for storage.

Figure 14:
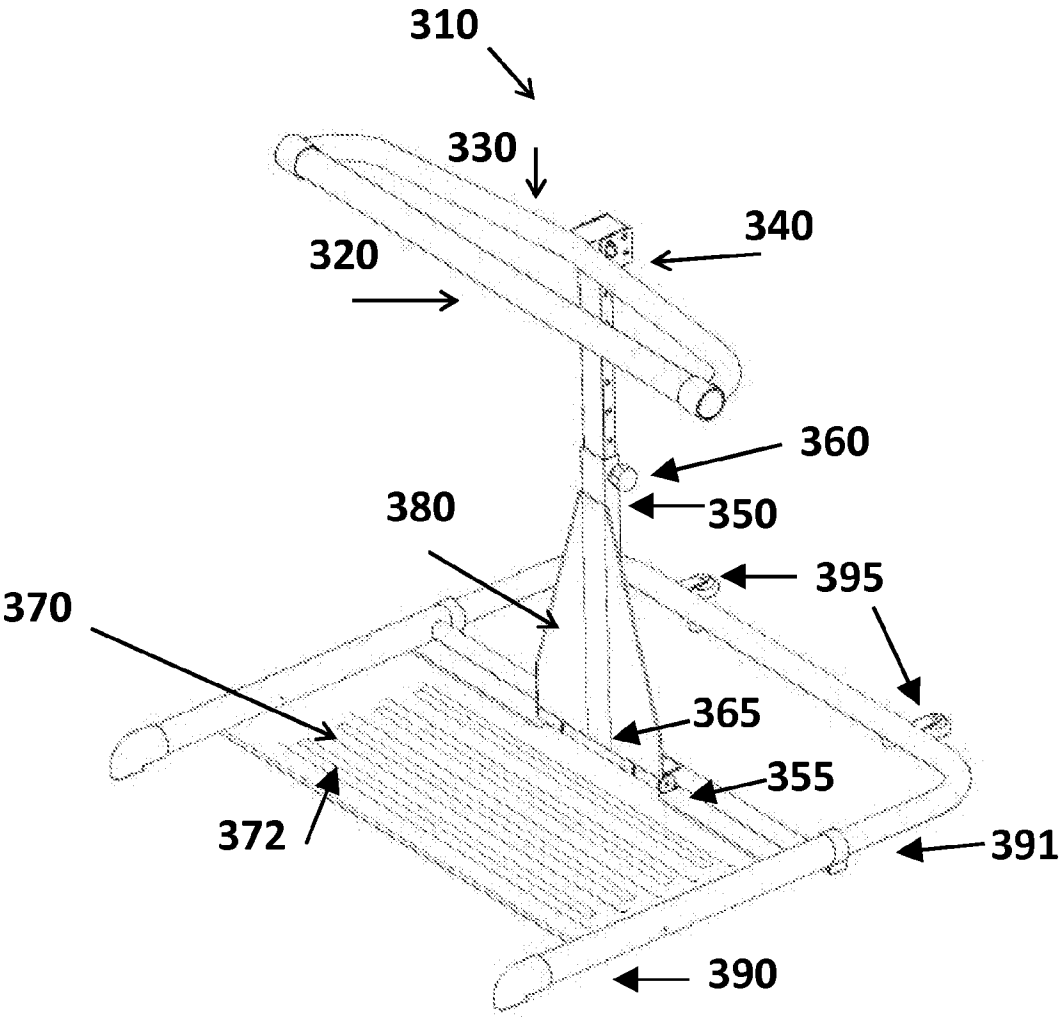
FIG. 14 depicts a fourth embodiment of a portable exercise bar.

A fourth embodiment is depicted in FIG. 14 as portable exercise bar 310. Portable exercise bar 310 comprises horizontal bar 320, u-shaped support bar 330, neck 340, vertical column 350, cross bar 355, locking device 360, floor board 370, backboard 380, base 390, and wheels 395. Base 390 comprises rear legs 391.

Horizontal bar 320 is coupled to support bar 330, support bar 330 is coupled to neck 340, neck 340 is coupled to vertical column 350, and vertical column 350 is coupled to backboard 380. Backboard 380 is coupled to cross bar 355 via hinge 365. Hinge 365 also is coupled to floor board 370. Cross bar 355 is coupled to base 370. Wheels 395 are coupled to rear legs 391. Rear legs 391 typically will be place in the fully extended position during use and retracted into base 370 for reduced size for storage. Thus, the size of base 370 is adjustable through the use of rear legs 391.

Floor board 370 optionally includes a plurality of ribs 372, which adds structural support to floor board 370.

Figure 15:
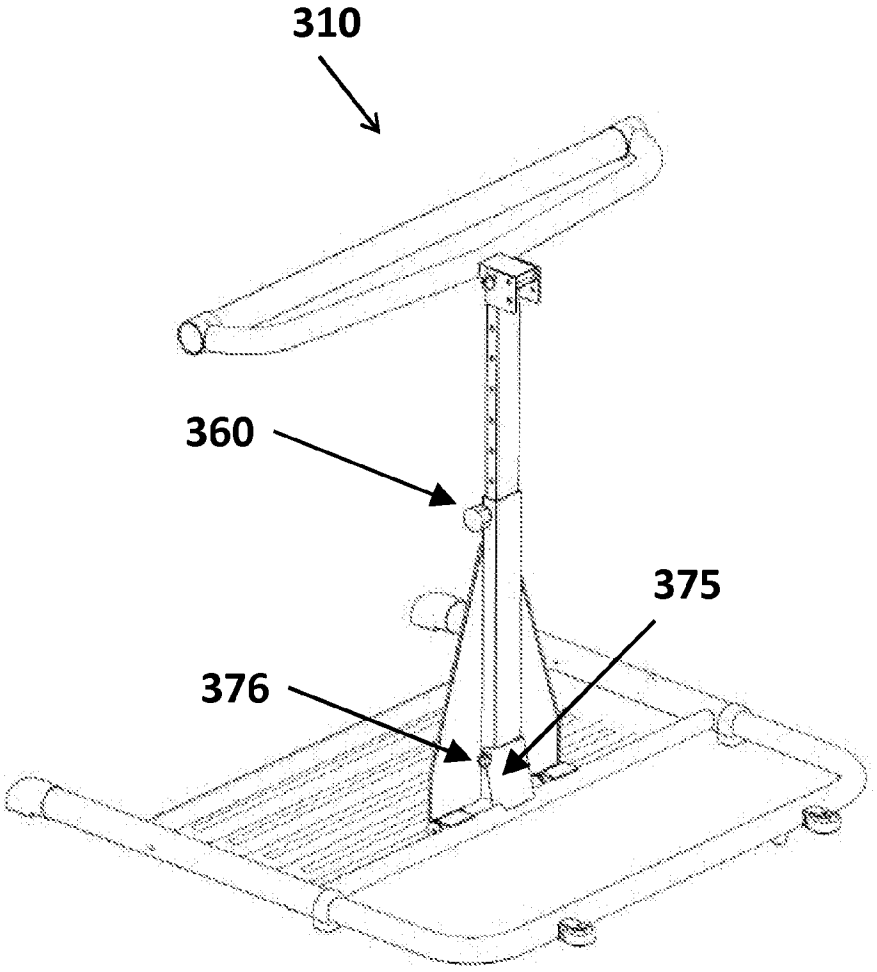
FIG. 15 depicts a back view of the fourth embodiment of a portable exercise bar.

Locking device 360 locks neck 340 and vertical column 350 when inserted. When locking device 360 is pulled out, neck 340 can move up or down freely within vertical column 350. Locking device 360 optionally can be a spring knob, detent pin, or any other known locking device FIG. 15 depicts a back view of portable exercise bar 310. Locking mechanism 375 comprises pin 376. When pin 376 is in place, locking mechanism 375 will be locked to vertical column 350. Locking mechanism 375 optionally is permanently fixed to cross bar 355.

Figure 16:
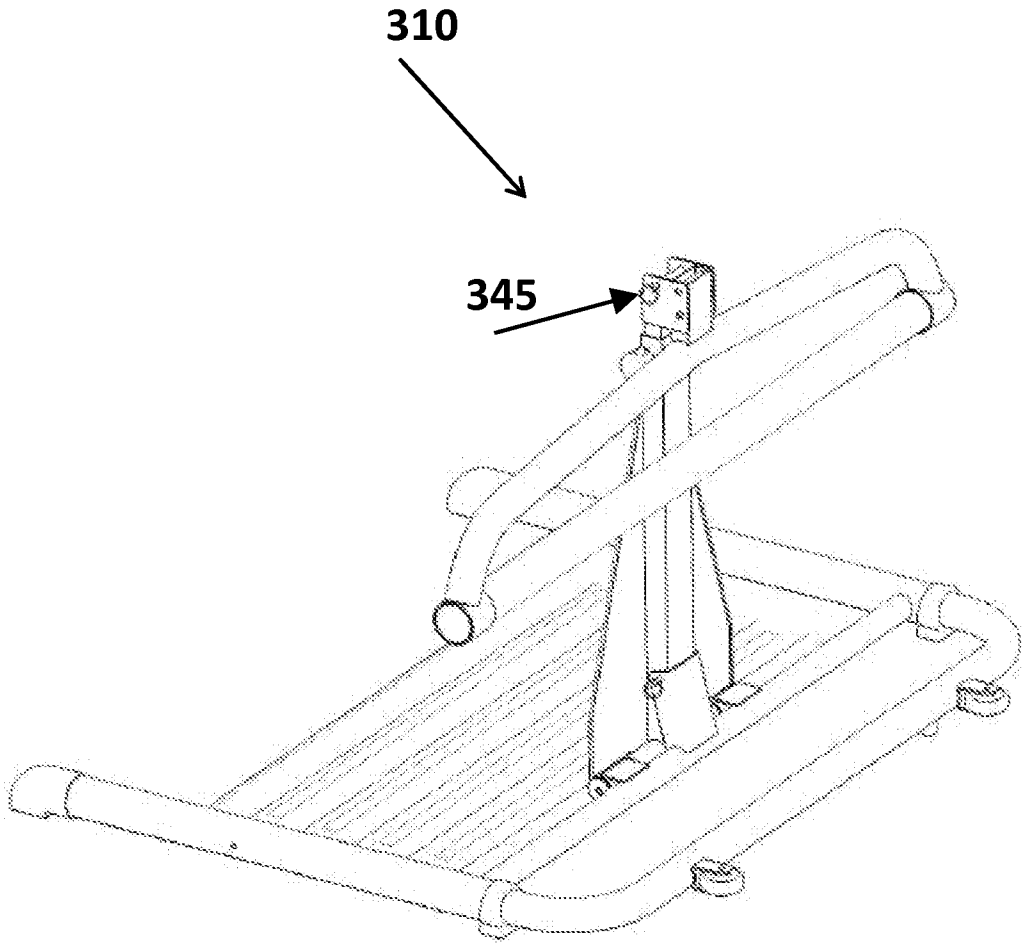
FIG. 16 depicts a back view of the fourth embodiment of a portable exercise bar in a partially collapsed position.

FIG. 16 depicts part of the process of collapsing portable exercise bar 310 for purposes of transportation or storage. When pin 345 is pulled, horizontal bar 320 and u-shaped support bar 330 can rotate around neck 340 as depicted. When locking device 360 is pulled, neck 340 can be pushed into vertical column 350 so that neck 340 is substantially nested within vertical column 350.

Figure 17:
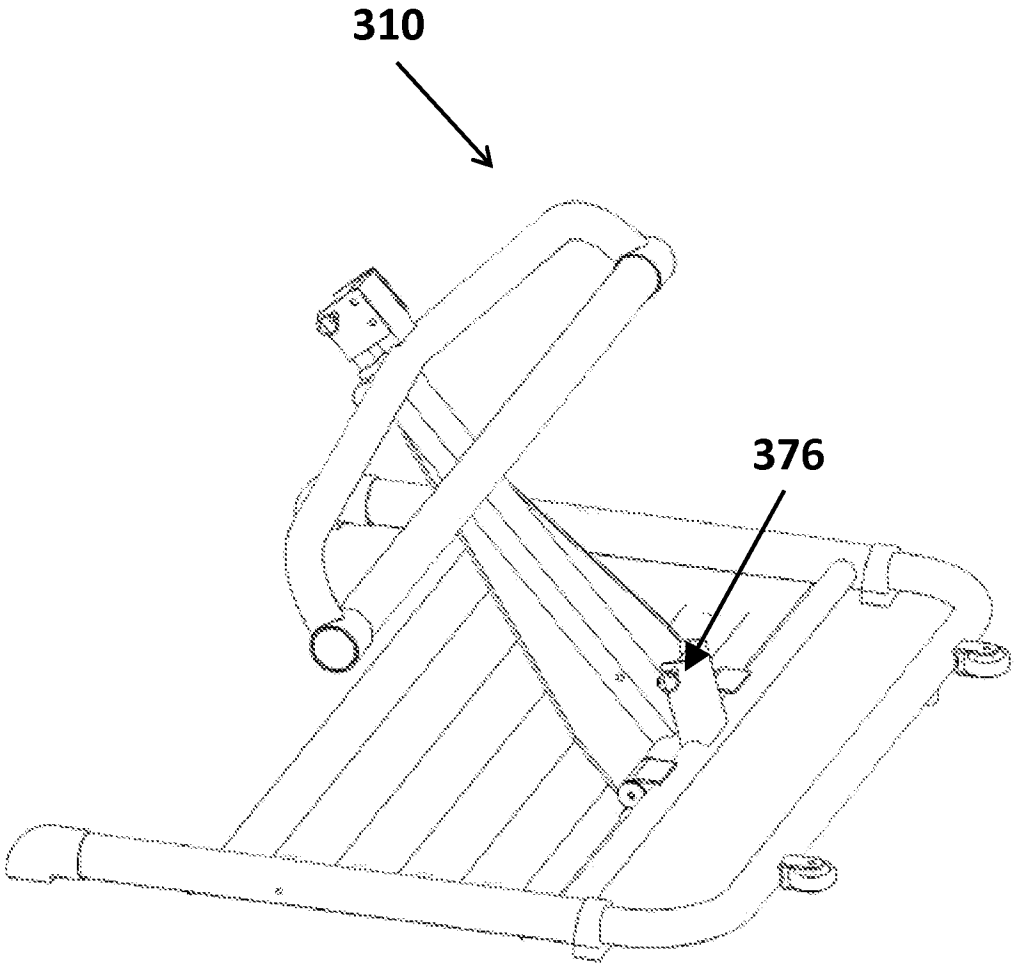
FIG. 17 depicts a back view of the fourth embodiment of a portable exercise bar in a partially collapsed position.
Figure 18:
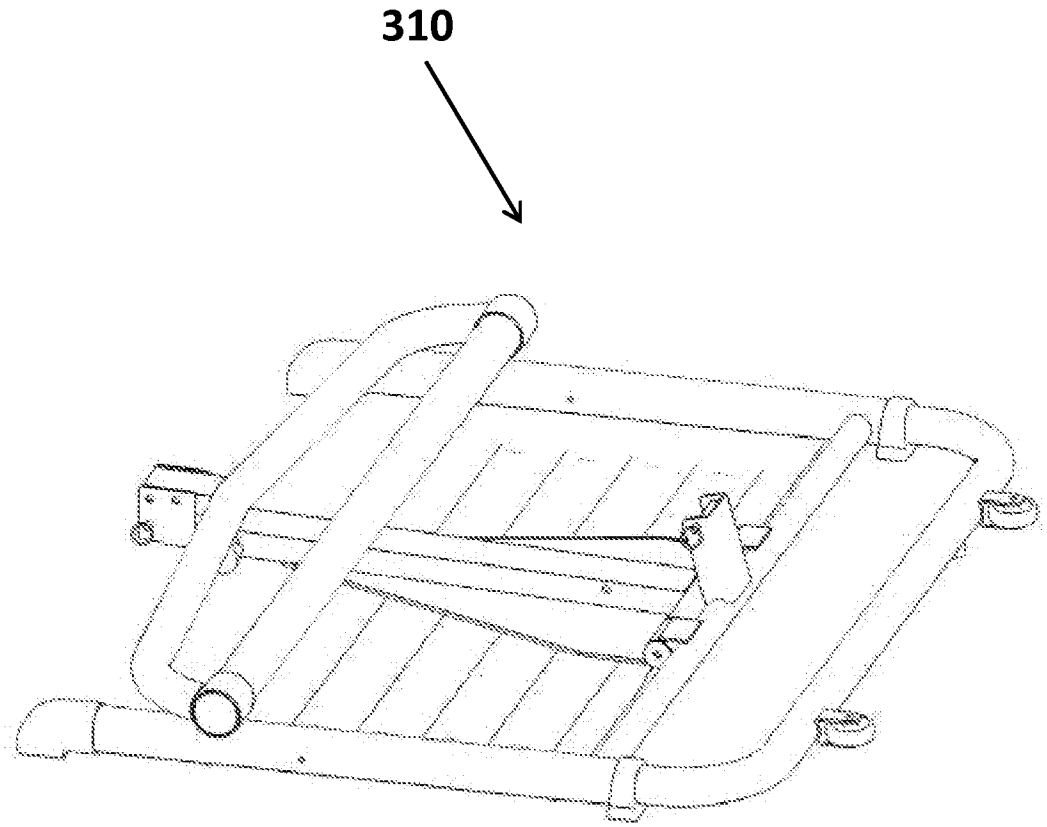
FIG. 18 depicts a back view of the fourth embodiment of a portable exercise bar in a collapsed position.

FIG. 17 depicts a subsequent portion of the process of collapsing portable exercise bar 310. Here, pin 376 is pulled, and locking mechanism 375 is thereby detached from vertical column 350. This allows vertical column 350 and all structures attached to it to fold downward toward floor board 370 along hinge 365, until it is in its folded position as shown in FIG. 18. As can be seen in FIG. 18, portable exercise bar 310 can be easily transported in the collapsed position by rolling the apparatus on wheels 395. Optionally, vertical column 350 or horizontal bar 320 can be temporarily attached to base 390 through a velcro strap, rope, bungy cord, or other attachment device (not shown) for ease of transportation and storage.

Figure 19:
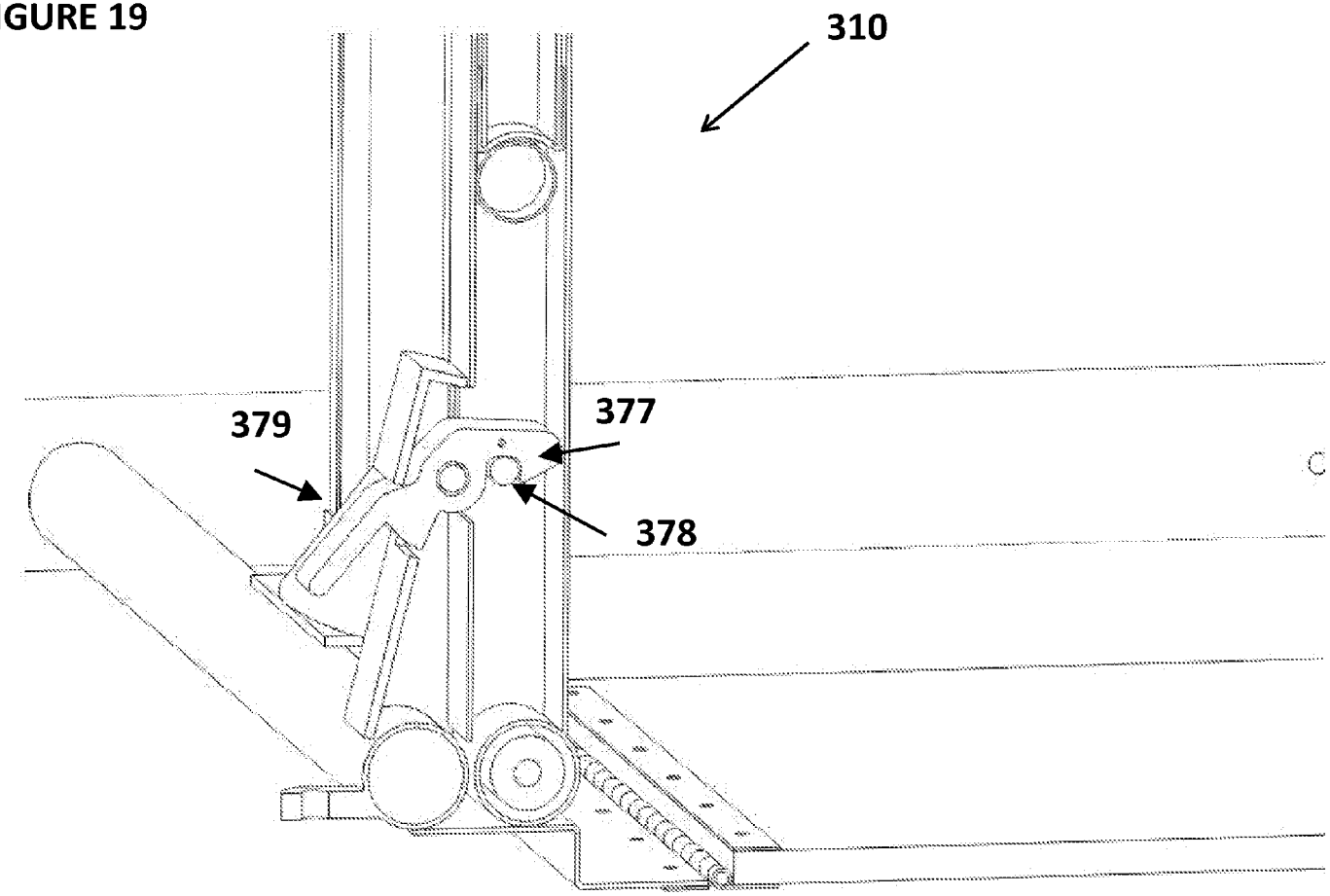
FIG. 19 depicts an alternative locking mechanism for the fourth embodiment of a portable exercise bar in a partially collapsed position.

FIG. 19 depicts an alternative to locking mechanism 375. Here, locking mechanism 379 comprises latch 377 and post 378. Locking mechanism 379 locks in place by attaching latch 377 around post 378. Locking mechanism 379 is unlocked by removing latch 377 from post 378, which allows vertical column 350 to fold down as described previously with reference to FIGS. 17 and 18.

Figure 20:
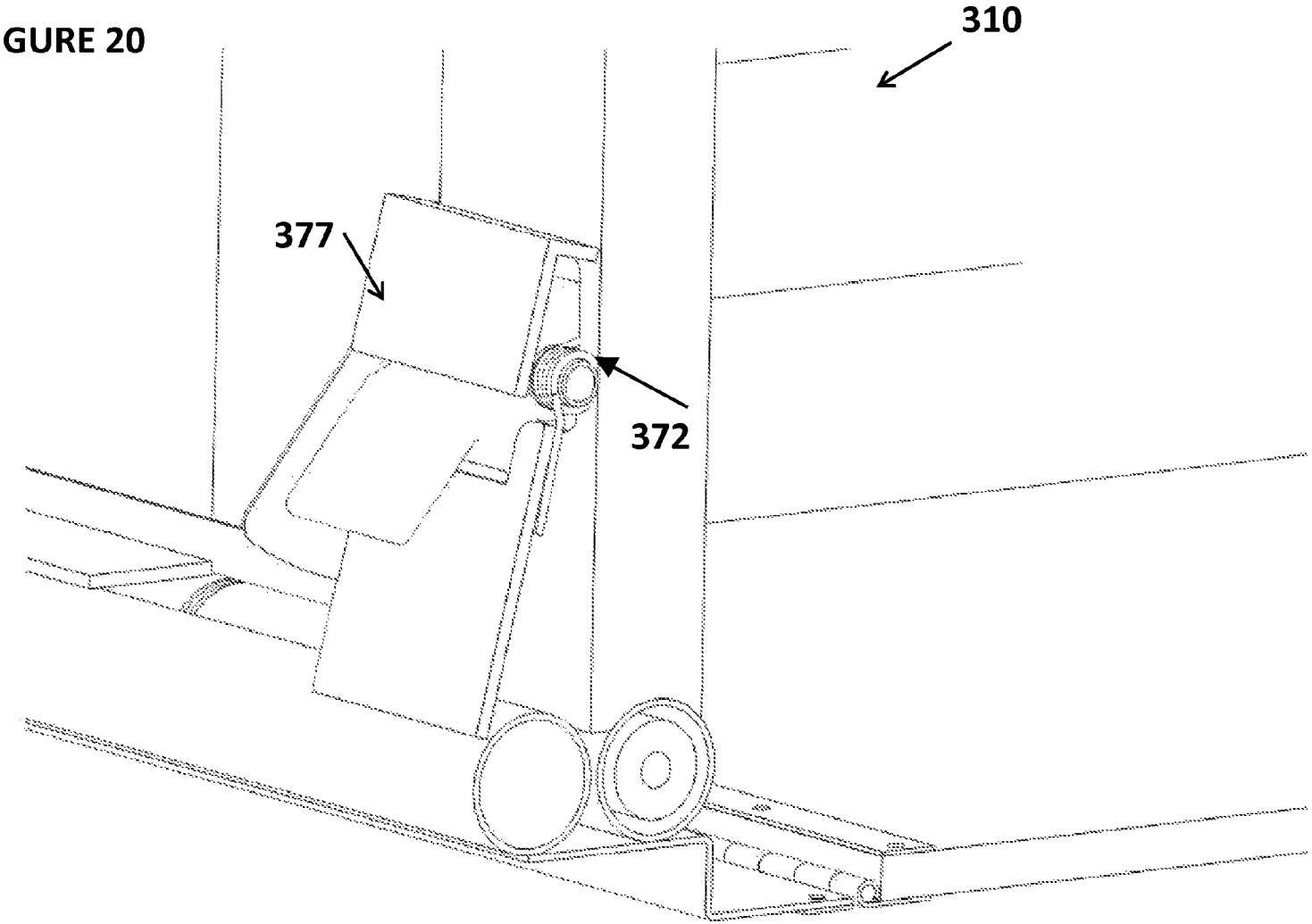
FIG. 20 depicts an alternative lock mechanism for the fourth embodiment of a portable exercise bar.

FIG. 20 depicts another view of locking mechanism 379. Torsion spring 372 holds latch 377 in the locked position on post 378. One or more such torsion springs can be used.

Figure 21:
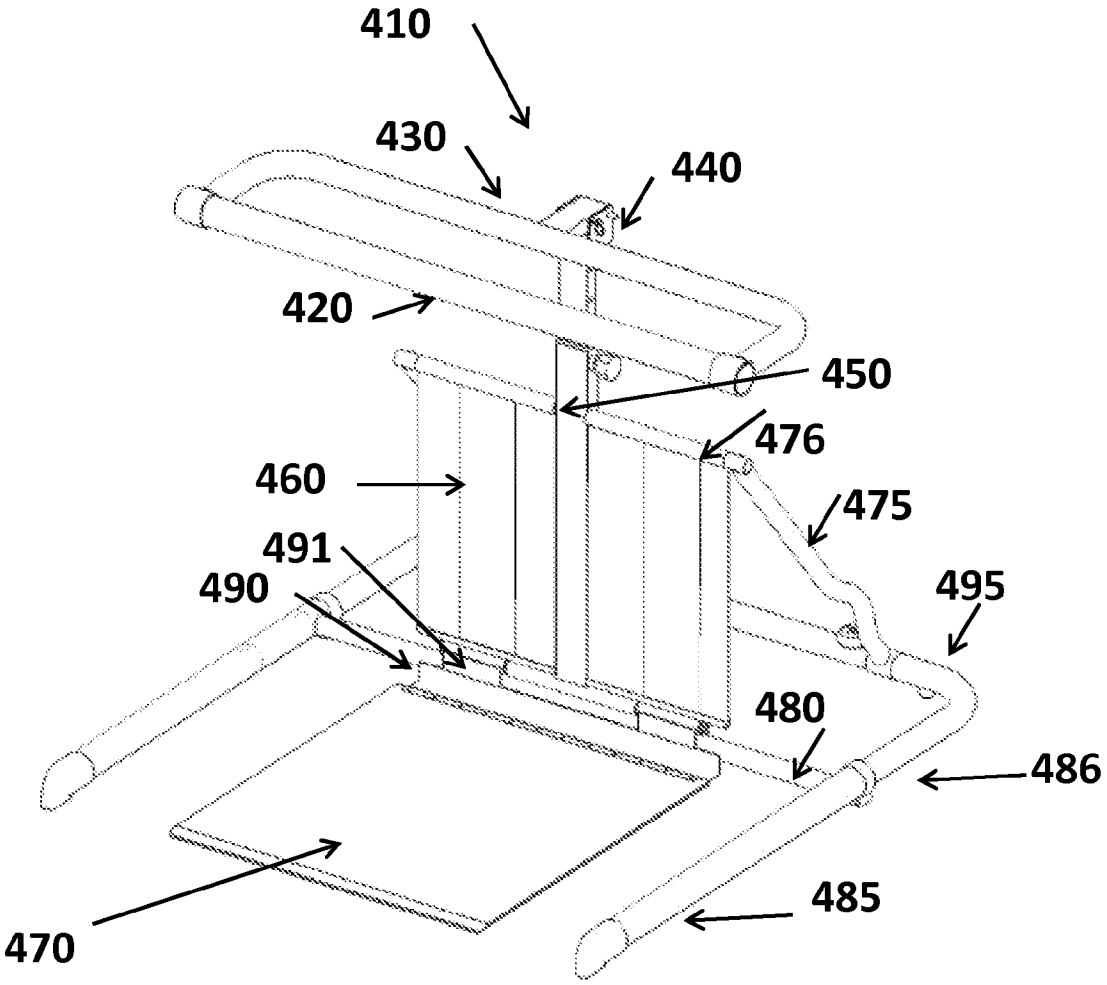
FIG. 21 depicts a fifth embodiment of a portable exercise bar.

A fifth embodiment is depicted in FIG. 21 as portable exercise bar 410. Portable exercise bar 410 comprises horizontal bar 420, u-shaped support bar 430, neck 440, vertical column 450, backboard 460, floor board 470, support members 475 (only one of which is depicted in FIG. 21), top cross bar 476, cross bar 480, base 485, floor board hinge 490, hinge 491, and wheels 495 (only one of which is depicted in FIG. 21). Base 485 comprises rear legs 486. Rear legs 486 typically will be place in the fully extended position during use and retracted into base 485 for reduced size for storage. Thus, the size of base 485 is adjustable through the use of rear legs 486.

Horizontal bar 420 is coupled to support bar 430, support bar 430 is coupled to neck 440, neck 440 is coupled to vertical column 450, and vertical column 450 is coupled to backboard 460. Backboard 460 is coupled to cross bar 480 via hinge 491. A floor board hinge 490 is coupled to floor board 470. Cross bar 480 is coupled to base 485. Wheels 495 are coupled to rear legs 486. Support members 475 are couple to top cross bar 476 and rear legs 486.

Figure 22:
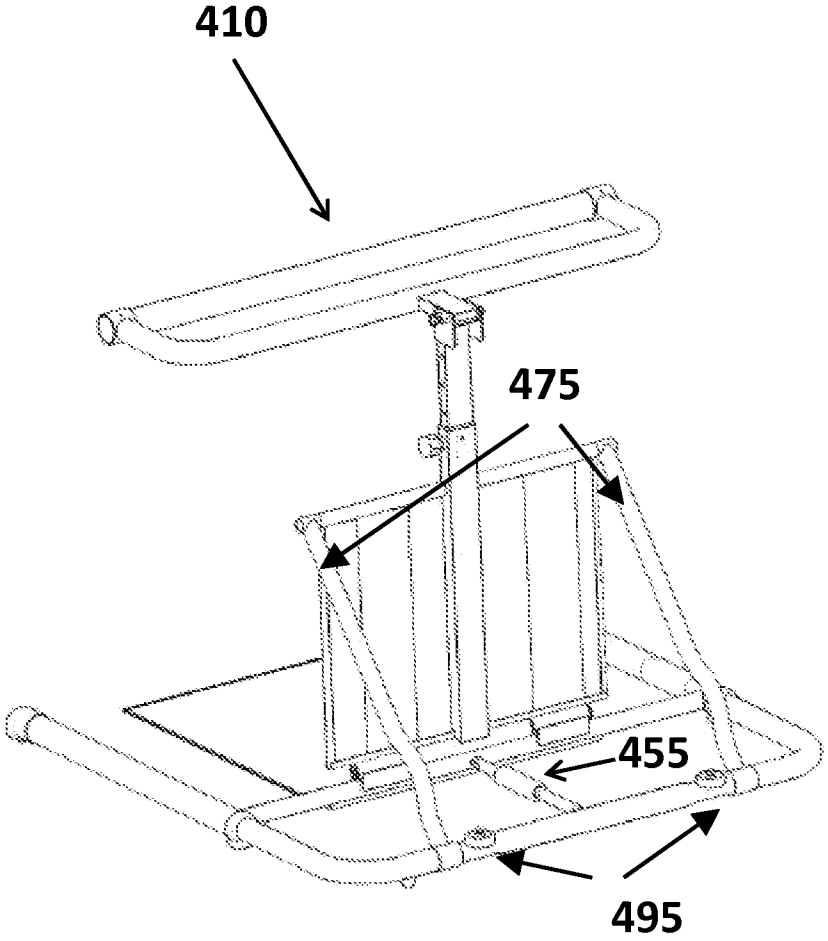
FIG. 22 depicts a back view of the fifth embodiment of a portable exercise bar.

FIG. 22 depicts a back view of portable exercise bar 410. Support members 475 and wheels 495 are shown. Locking mechanism 455 is depicted. Locking mechanism 455 is coupled to cross bar 480 and rear legs 486.

Figure 23:
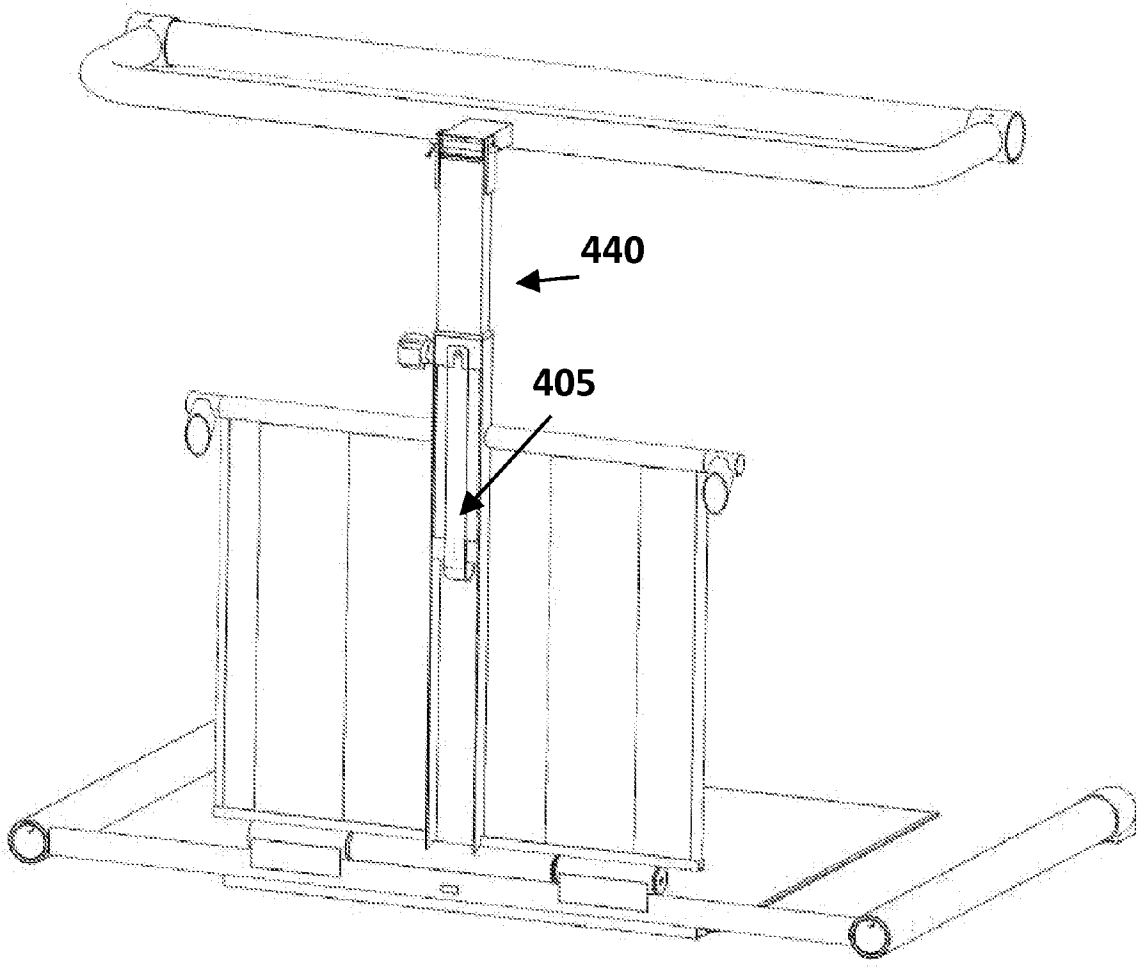
FIG. 23 depicts a constant force spring mechanism used in the fifth embodiment of a portable exercise bar.

FIG. 23 depicts a back view of a portion of portable exercise bar 410. Constant force spring 405 is contained within vertical column 450. One end of constant force spring 405 is connected to vertical column 450. The other end of constant force contacts the bottom of neck 440. During the collapsing process, when a user pushes neck 440 into vertical column 450, constant force spring will counterbalance the weight of neck 440. This may be useful because, without constant force spring 405, the weight of the structures could cause the collapsing to occur quickly. Constant force spring 405 will cause the collapsing to occur at a slower, relatively constant rate. The constant force spring also assists the user in raising neck 440 to the proper height.

Figure 24:
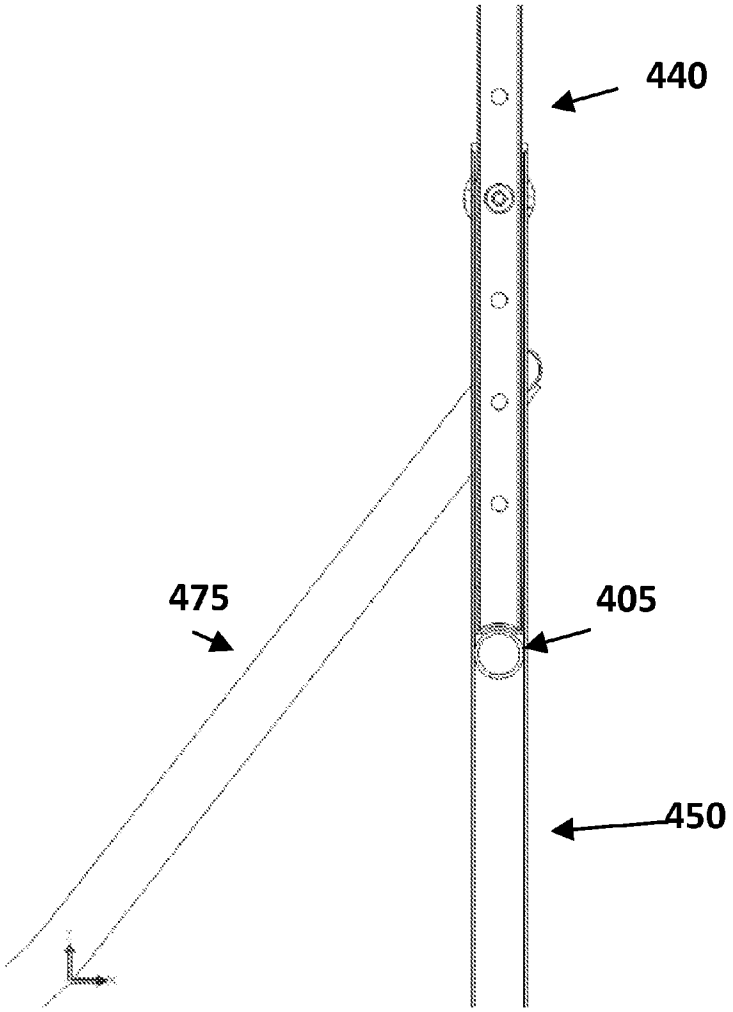
FIG. 24 depicts a side view of a cross section of a constant force spring in the fifth embodiment of a portable exercise bar.

FIG. 24 neck 440 and constant force spring 405 supporting neck 440.

In the alternative, in place of constant force spring 405, a friction fit between neck 440 and vertical column 450 can be added to create friction whenever a user attempts to move neck 440 into or out of vertical column 450.

When portable exercise bar 410 is expanded (such as when a user takes it from storage and sets it up for use), the user pulls vertical column 475 upward from the compressed configuration. Locking mechanism 455 and support members 475 will exert force on rear legs 486 such that rear legs will extend from base 485 automatically in response to vertical column 475 being pulled upward. This is a convenient feature for a user and saves the step of separately extending rear legs 486 from base 485.

Figure 25:
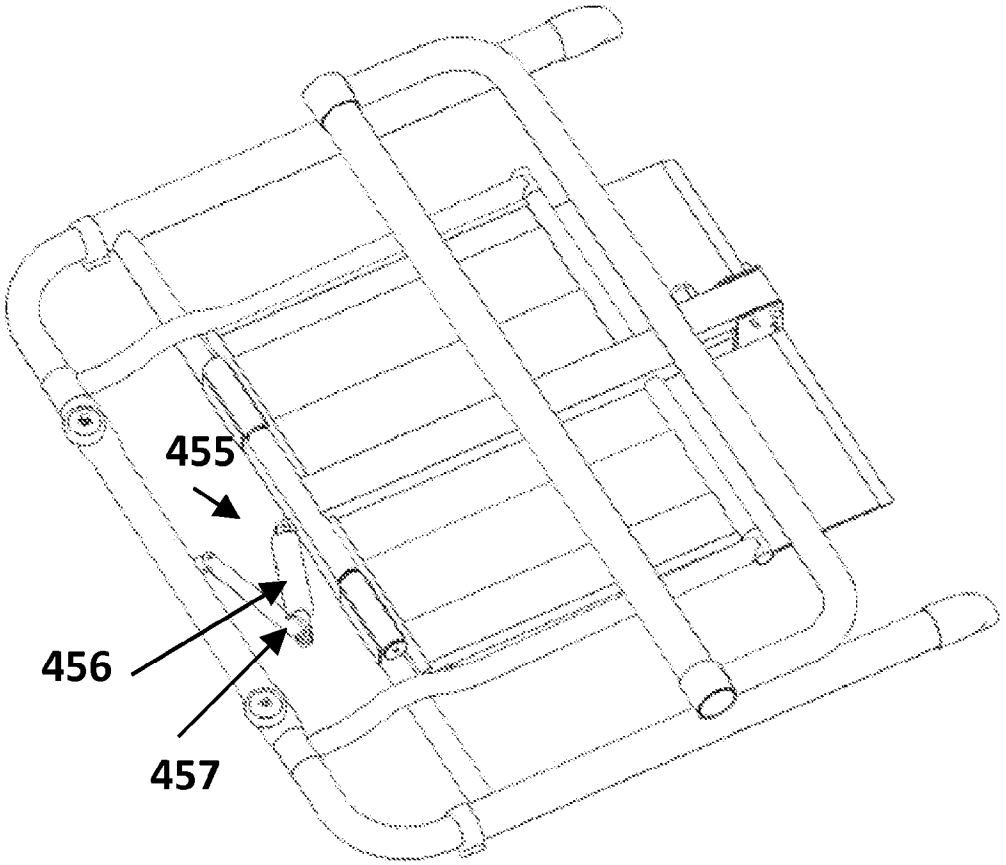
FIG. 25 depicts a locking mechanism for the fifth embodiment of a portable exercise bar.

FIG. 25 depicts a portion of the collapsing process for portable exercise bar 410. Locking mechanism 455 comprises a movable sheath 456. When the portable exercise bar 410 is fully assembled (after the expansion process, in which the portable exercise bar 410 is configured to its normal operating position), movable sheath 456 is moved to surround hinge 457. This prevents locking mechanism 455 from bending on hinge 457, which in turn will keep vertical column 450 upright. During the collapsing process, a user will move movable sheath 456 so that hinge 457 is exposed. This allows locking mechanism 455 to bend, and vertical column 450 and its attached structures are able to collapse.

In the alternative, a telescoping locking mechanism can be used in place of locking mechanism 455.

Figure 26:
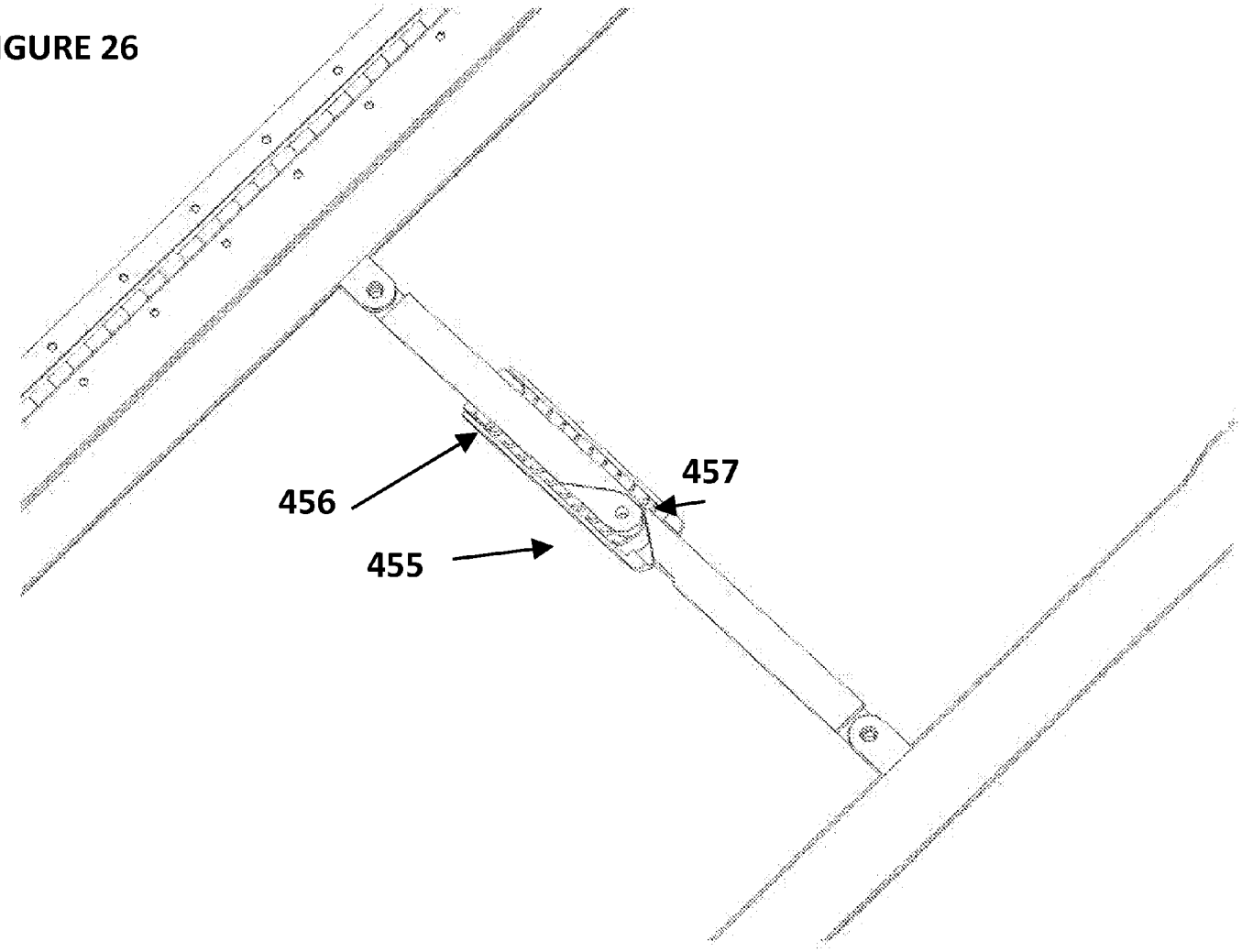
FIG. 26 depicts a locking mechanism for the fifth embodiment of a portable exercise bar.

FIG. 26 depicts an internal view of locking mechanism 455 and the relationship of movable sheath 456 and hinge 457.

Figure 27:
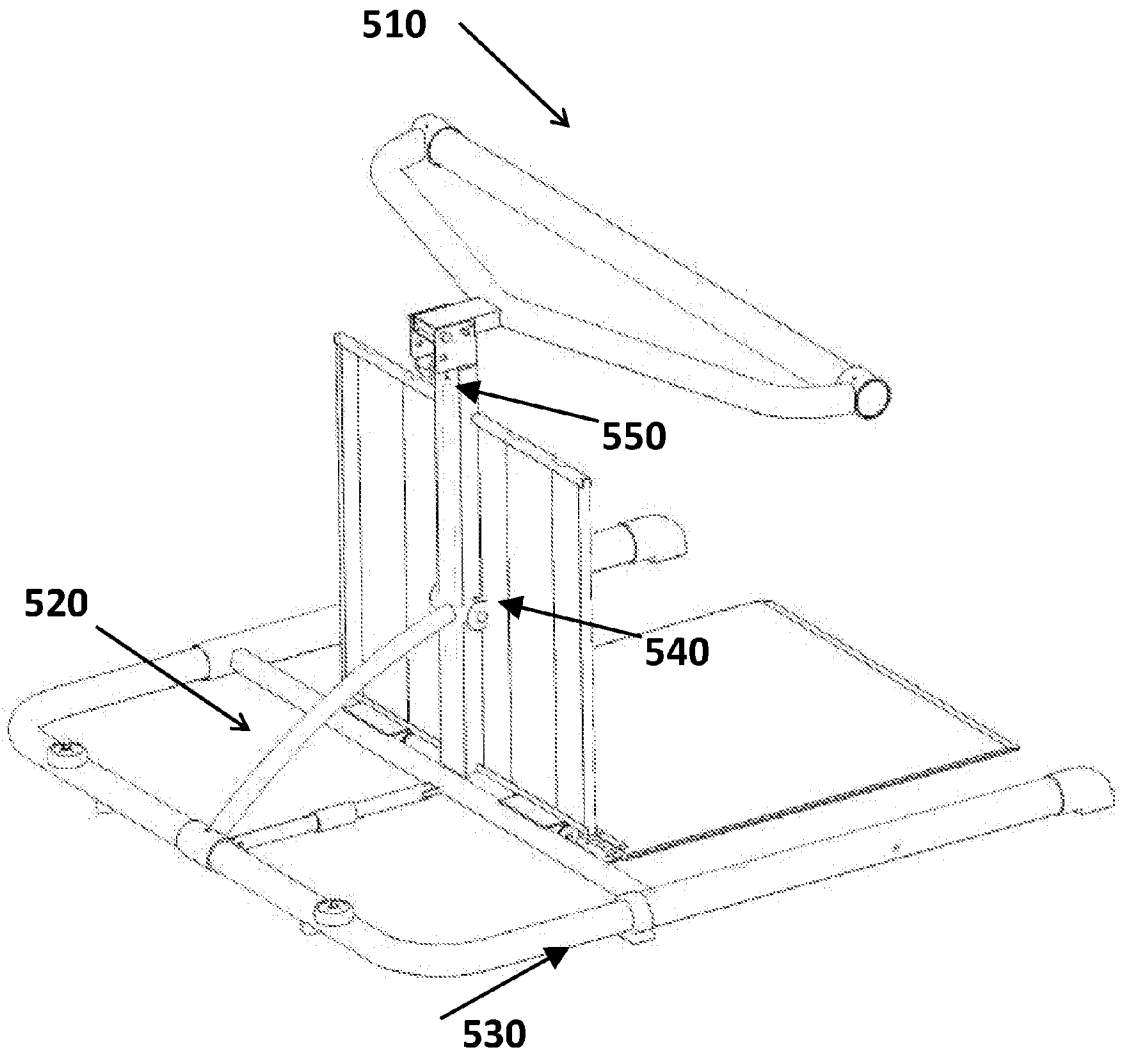
FIG. 27 depicts a sixth embodiment of a portable exercise bar.

A sixth embodiment is shown in FIG. 27 as a portable exercise bar 510. Many of the parts of this embodiment are the same as the previous embodiment discussed with reference to FIGS. 1-26, and for efficiency's sake, those will not be described again. Portable exercise bar 510 comprises support member 520. Support member is attached to rear legs 530 and hinge point/locking mechanism 540 on vertical column 550. Hinge point/locking mechanism 540 can be released to allow hinge point to rotate thereby allowing vertical column 550 to collapse. Locking mechanism optionally can comprise a spring knob, detent pin, or other locking mechanism.

Figure 28:
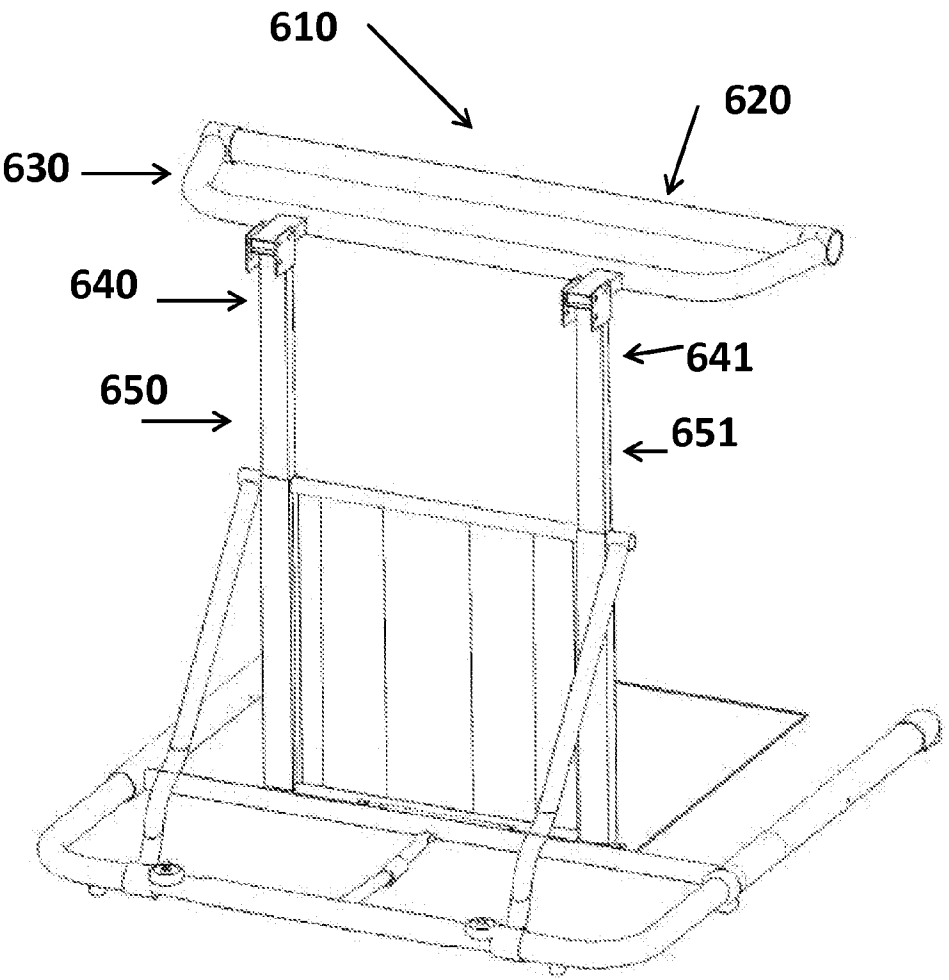
FIG. 28 depicts a back view of a seventh embodiment of a portable exercise bar.

A seventh embodiment is shown in FIG. 28 as a portable exercise bar 610. Many of the parts of this embodiment are the same as the previous embodiment discussed with reference to FIGS. 1-27, and for efficiency's sake, those will not be described again. Portable exercise bar 610 comprises horizontal bar 620 coupled to u-shaped support bar 630. U-shaped support bar 630 is coupled to neck 640 and neck 641. Neck 640 is coupled to vertical column 650, and neck 641 is coupled to vertical column 651. The design is otherwise similar to that of the embodiments described previously.

In the seven embodiments described above, horizontal bars 20, 240, 320, 420, 620 and any other horizontal bars described above or shown in FIGS. 1-28 optionally are constructed from wood and can resemble a traditional ballet bar. In the alternative, they can be constructed from steel or another firm material. Floor boards 80, 370, 470, and any other floor boards described above or shown in FIGS. 1-28 optionally are constructed from wood, for example, from plywood. In the alternative, they can be constructed from steel, rubber, or plastic. The remainder of the parts optionally can be constructed from steel or other rigid material. Back boards 40, 380, and 460 can comprise one of any number of shapes. For example, back boards 40, 380, and 460 can be triangular, rectangular, or any other shape.

References to the present invention herein are not intended to limit the scope of any claim or claim term, but instead merely make reference to one or more features that may be covered by one or more of the claims. Materials, processes and numerical examples described above are exemplary only, and should not be deemed to limit the claims. It should be noted that, as used herein, the terms "over" and "on" both inclusively include "directly on" (no intermediate materials, elements or space disposed there between) and "indirectly on" (intermediate materials, elements or space disposed there between). Likewise, the term "adjacent" includes "directly adjacent" (no intermediate materials, elements or space disposed there between) and "indirectly adjacent" (intermediate materials, elements or space disposed there between). For example, forming an element "over a substrate" can include forming the element directly on the substrate with no intermediate materials/elements there between, as well as forming the element indirectly on the substrate with one or more intermediate materials/elements there between.

What is claimed is:

1. A portable ballet bar exercise device, comprising:

a single vertical column;

a horizontal bar coupled to a single pivotable neck, the neck coupled to the single vertical column such that the horizontal bar is pivotable about the single vertical column, wherein the single vertical column is adjustable in height and is capable of being locked in place by a locking mechanism;

a cross bar coupled to the single vertical column and spanning a base structure; and a floor board coupled to the cross bar;

wherein the single vertical column can operate in a first position approximately perpendicular to the base structure, and wherein the single vertical column is foldable about an axis of the cross bar to a second position approximately parallel to the base structure.

2. The device of claim 1, wherein the base structure comprises rear legs that are extendable from the base structure.

3. The device of claim 2, wherein the device further comprises a back board.

4. The device of claim 3, wherein the single pivotable neck comprises at least two pieces.

5. The device of claim 4, wherein the device further comprises a plurality of wheels.

6. The device of claim 5, wherein the device further comprises a spring within the single vertical column.

7. The device of claim 6, wherein the spring is a constant force spring.

8. The device of claim 7, wherein the back board is constructed from wood.

9. The device of claim 8, wherein the floor board is constructed from wood.

10. The device of claim 9, wherein the device further comprises a locking mechanism coupled to the rear legs and the cross bar.

11. A portable ballet bar exercise device, comprising:

a horizontal bar coupled to a support mechanism;

a single pivotable neck coupled to the support mechanism;

a single vertical column attached to the neck such that the horizontal bar and support mechanism are pivotable about the single vertical column, wherein the single vertical column is adjustable in height and is capable of being locked in place by a locking mechanism;

a first cross bar coupled to the single vertical column;

a floor board coupled to the first cross bar;

a backboard coupled to the first cross bar;

a base structure coupled to the first cross bar; and a locking mechanism coupled to the first cross bar and the base structure;

wherein the single vertical column can operate in a first position approximately perpendicular to the base structure, and wherein the single vertical column is foldable about an axis of the first cross bar to a second position approximately parallel to the base structure.

12. The device of claim 11, wherein the base structure comprises rear legs that are extendable from the base structure.

13. The device of claim 12, wherein the device further comprises one or more support structures coupled to a second cross bar and the base structure.

14. The device of claim 13, wherein the support mechanism is U-shaped.

15. The device of claim 14, wherein the device further comprises a plurality of wheels.

16. The device of claim 15, wherein the device further comprises a spring within the single vertical column.

17. The device of claim 16, wherein the spring is a constant force spring.

18. The device of claim 17, wherein the floor board is constructed from wood.

19. The device of claim 18, wherein the device further comprises a locking mechanism coupled to the single vertical column and the first cross bar.

* * * * *